US009585493B2

(12) United States Patent
Haut et al.

(10) Patent No.: US 9,585,493 B2
(45) Date of Patent: Mar. 7, 2017

(54) INFANT BED APPARATUS

(71) Applicant: Wonderland Nurserygoods Company Limited, Central Hong Kong (HK)

(72) Inventors: Robert E. Haut, West Chester, PA (US); Jonathan K. Mountz, Geigertown, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 585 days.

(21) Appl. No.: 14/030,829

(22) Filed: Sep. 18, 2013

(65) Prior Publication Data

US 2014/0075671 A1 Mar. 20, 2014

Related U.S. Application Data

(60) Provisional application No. 61/744,160, filed on Sep. 19, 2012, provisional application No. 61/796,303, filed on Nov. 6, 2012, provisional application No. 61/854,394, filed on Apr. 23, 2013.

(51) Int. Cl.
*A47D 9/02* (2006.01)

(52) U.S. Cl.
CPC ..... *A47D 9/02* (2013.01)

(58) Field of Classification Search
CPC ... A47D 9/00; A47D 9/02; A47D 9/04; A47D 13/10; A47D 13/102; A47D 13/105; A47C 21/006
USPC ..... 5/108, 109
See application file for complete search history.

(56) References Cited

U.S. PATENT DOCUMENTS

| | | | | |
|---|---|---|---|---|
| 2,106,927 | A * | 2/1938 | Kinnear | A47D 9/02 297/130 |
| 3,261,032 | A * | 7/1966 | Reardon | A47D 9/02 5/108 |
| 3,546,950 | A | 12/1970 | Tinetti | |
| 4,021,867 | A * | 5/1977 | Maxwell, Jr. | A47D 9/02 297/270.2 |
| 6,386,986 | B1 | 5/2002 | Sonner et al. | |
| 6,540,292 | B2 * | 4/2003 | Darling | A47D 13/102 297/130 |
| 7,203,981 | B1 | 4/2007 | Cowgill | |
| 7,685,657 | B1 | 3/2010 | Hernandez et al. | |
| 8,205,943 | B2 * | 6/2012 | Zhong | A47D 13/102 297/258.1 |
| 2006/0225204 | A1 * | 10/2006 | Bretschger | A47D 9/02 5/93.1 |
| 2009/0029786 | A1 * | 1/2009 | Chen | A47D 13/105 472/119 |
| 2009/0113625 | A1 * | 5/2009 | Hutchinson | A47D 7/04 5/93.1 |

(Continued)

*Primary Examiner* — Nicholas Polito
(74) *Attorney, Agent, or Firm* — Baker & McKenzie LLP; David I. Roche

(57) ABSTRACT

An infant bed apparatus includes a support frame, a bed frame for defining an interior space suitable for receiving a child, and a motorized drive unit. The support frame includes a first and a second housing disposed at two locations spaced-apart from each other along a lengthwise axis of the infant bed apparatus. The bed frame has a first portion anchored with the first housing, and a second portion assembled with the second housing. The motorized drive unit is operable to drive the second portion of the bed frame in movement relative to the second housing.

33 Claims, 23 Drawing Sheets

(56) References Cited

U.S. PATENT DOCUMENTS

2011/0041245 A1 2/2011 Shafer et al.

* cited by examiner

414

100'

INFANT BED APPARATUS

CROSS-REFERENCE TO RELATED APPLICATIONS

This non-provisional patent application respectively claims priority to U.S. Provisional Patent Application No. 61/744,160 filed on Sep. 19, 2012; to U.S. Provisional Patent Application No. 61/796,303 filed on Nov. 6, 2012; and to U.S. Provisional Patent Application No. 61/854,394 filed on Apr. 23, 2013, which are incorporated herein by reference.

BACKGROUND

1. Field of the Invention

The present inventions relate to apparatuses for calming a baby and facilitating sleeping, and more particularly to infant bed apparatuses.

2. Description of the Related Art

In the early stages of a baby's life, sleeping, crying, diaper changes and feeding are part of a routine that is performed multiple times a day. The most desirable time of that routine can be a calm baby and the peaceful and quiet environment that a sleeping baby can provide for the caregiver. Therefore, there is a need for an infant bed apparatus that can create a safe sleeping environment for the child, with the option of a soothing motion to help calm the child and prolong a few more precious moments of quiet time for the caregiver.

SUMMARY

The present application describes infant bed apparatuses that can provide a variety of motions to help calm and soothe a child. In one embodiment, an infant bed apparatus includes a support frame, a bed frame for defining an interior space suitable for receiving a child, and a motorized drive unit. The support frame includes a first and a second housing disposed at two locations spaced-apart from each other along a lengthwise axis of the infant bed apparatus. The bed frame has a first portion anchored with the first housing, and a second portion assembled with the second housing. The motorized drive unit is operable to drive the second portion in movement relative to the second housing.

DETAILED DESCRIPTION OF THE EMBODIMENTS

Figure 1:
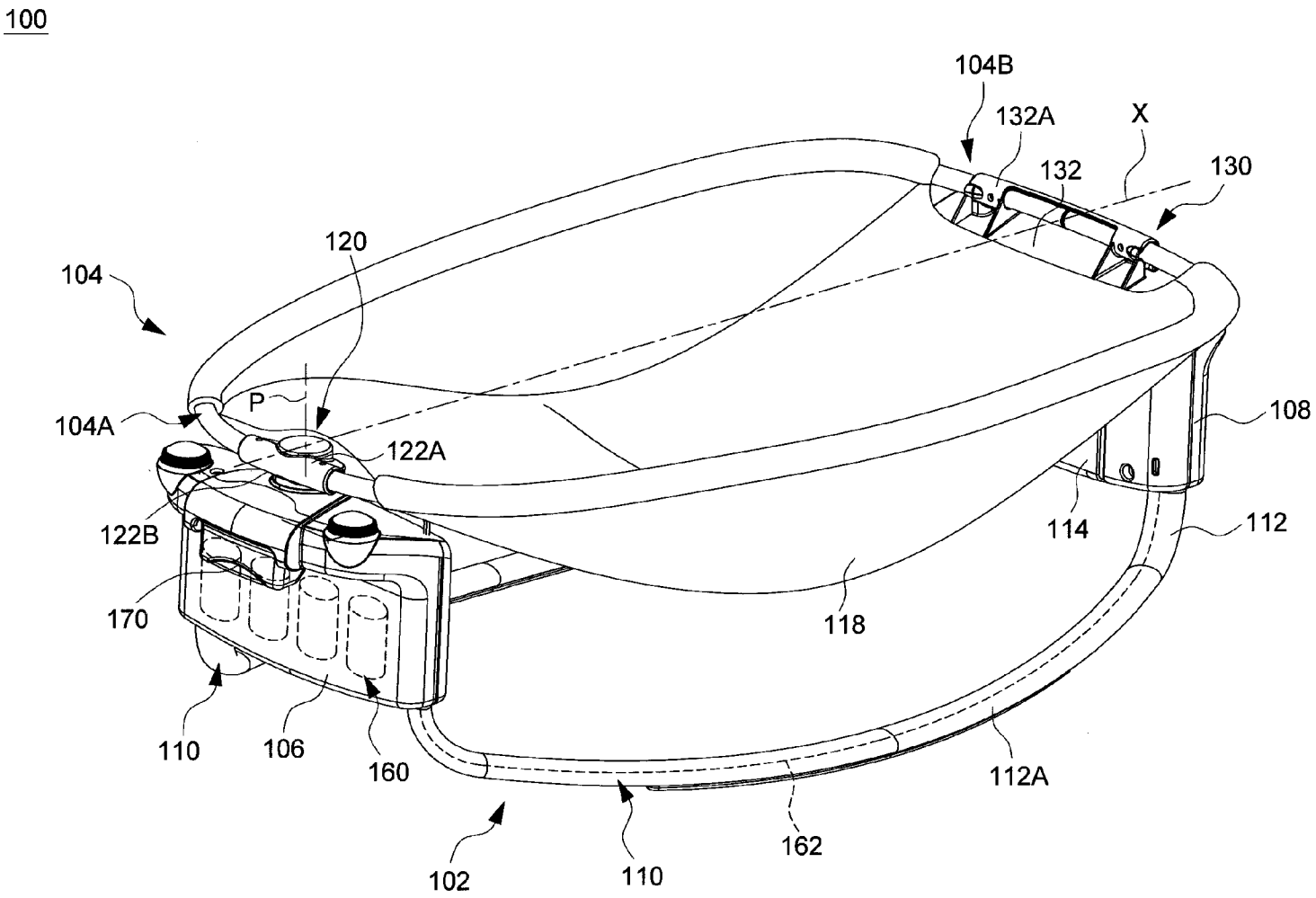
FIG. 1 is a perspective view illustrating an embodiment of an infant bed apparatus.
Figure 2:
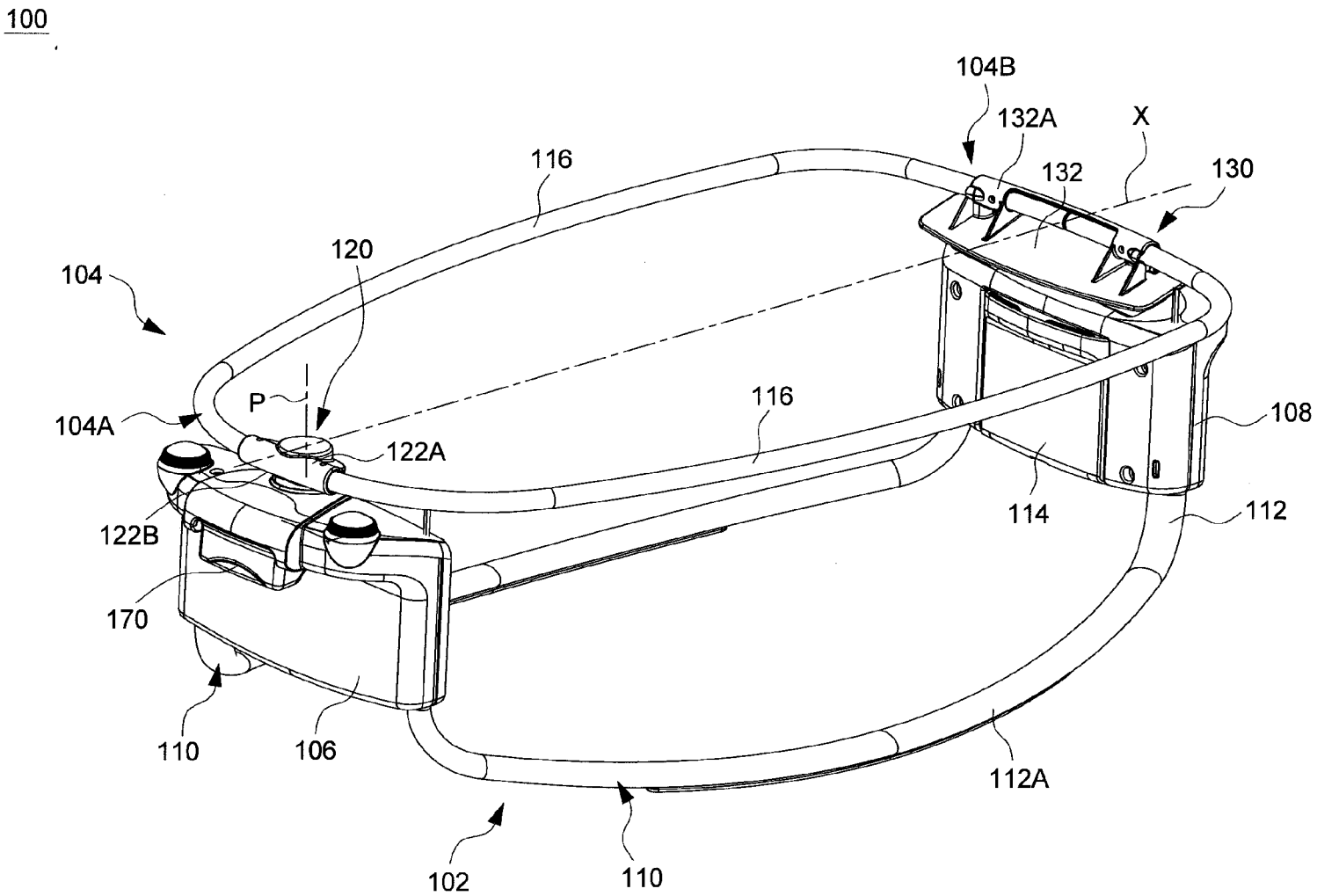
FIG. 2 is a perspective view illustrating the construction of a rigid frame structure of the infant bed apparatus.
Figure 3:
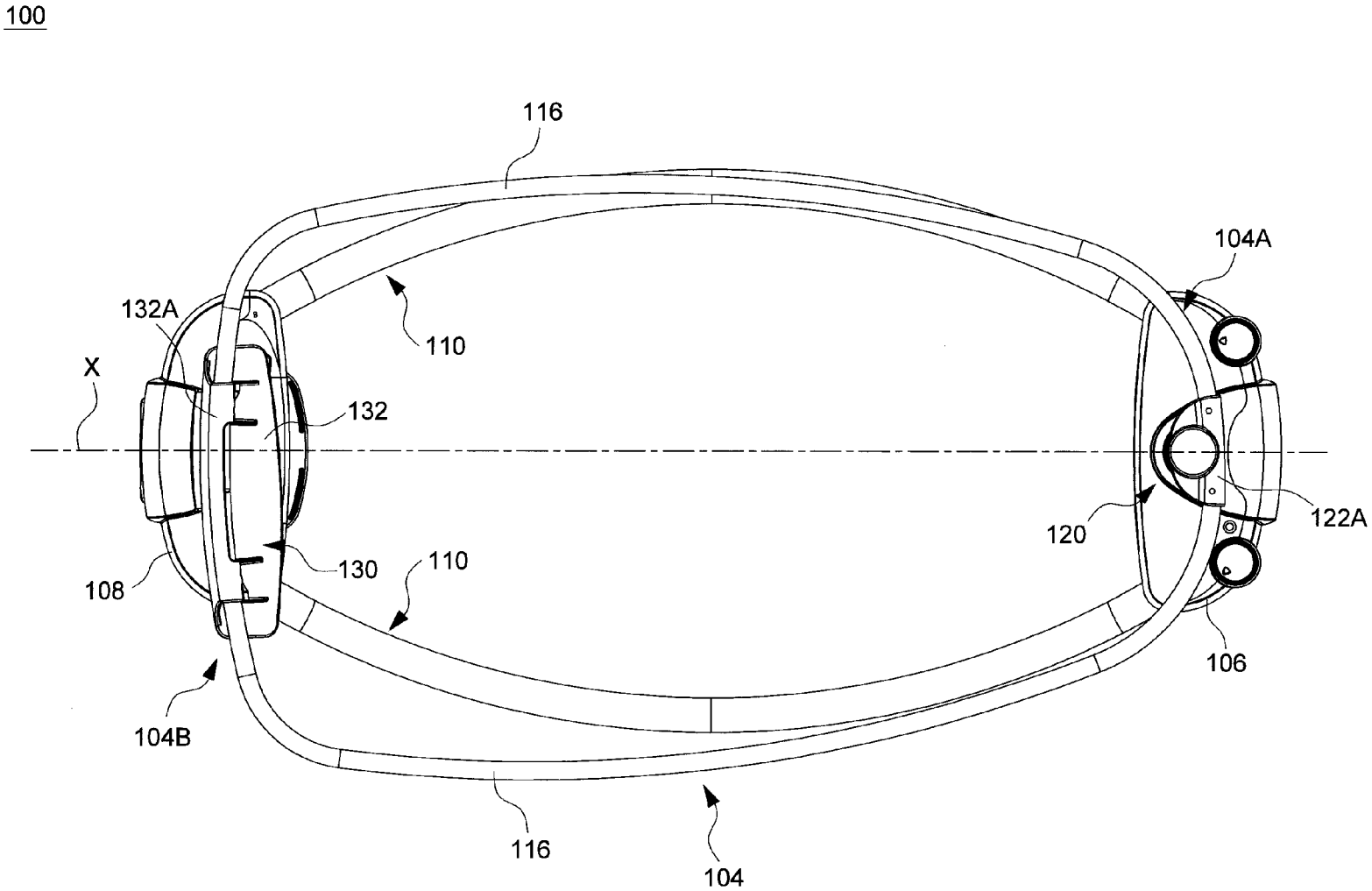
FIG. 3. is a top view illustrating the frame structure of the infant bed apparatus.

FIG. 1 is a perspective view illustrating an embodiment of an infant bed apparatus 100, FIG. 2 is a perspective view illustrating the construction of a rigid frame structure of the infant bed apparatus 100, and FIG. 3 is a top view illustrating the frame structure of the infant bed apparatus 100. The infant bed apparatus 100 can include a support frame 102, and a bed frame 104 connected with the support frame 102. The support frame 102 can rest on a resting surface (e.g., a ground or table surface) to provide support for the bed frame 104. The support frame 102 can include two housings 106 and 108 spaced apart from each other along a lengthwise axis X of the infant bed apparatus 100, and foot portions 110 that are connected with the housings 106 and 108 and extend at an underside of the housings 106 and 108. The lengthwise axis X can correspond to the direction of placement of child in the bed frame 104, i.e., the head and legs of the child are disposed along the lengthwise axis X.

Figure 4:
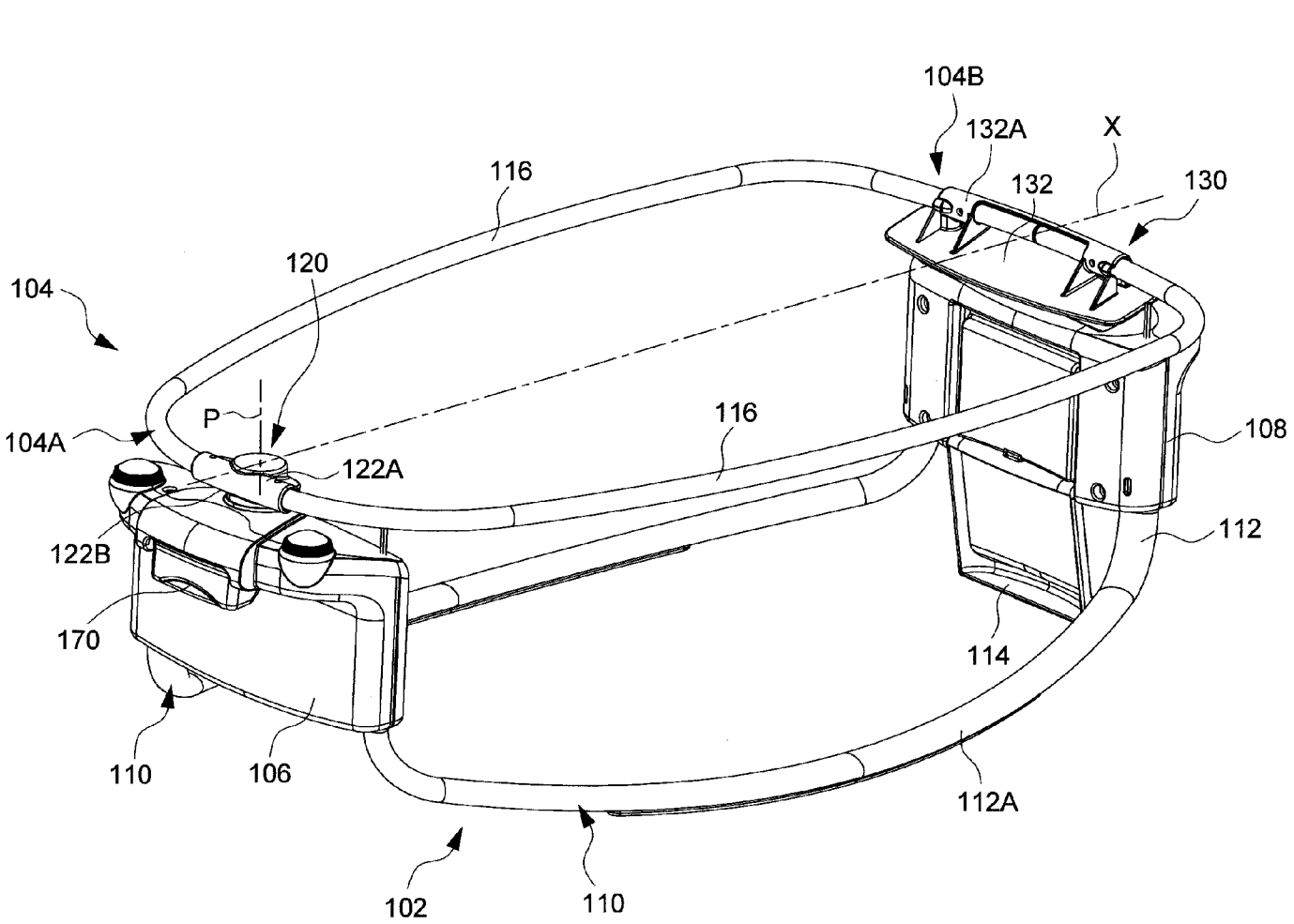
FIG. 4 is a schematic view illustrating the infant bed apparatus configured to lie in a stable stationary position.

In one embodiment, each of the foot portions 110 can be formed from a tube 112 that has two opposite portions respectively connected with the housings 106 and 108, and a curved portion 112A extending between the two ends along the lengthwise axis X. The curved portions 112A can allow the infant bed apparatus 100 to rock on the resting surface. A stabilizer foot 114 may also be assembled with one of the two housings 106 and 108 (e.g., the housing 108) at a location between the two foot portions 110. As shown in FIG. 4, when the infant bed apparatus 100 is used in a stable stationary condition on a resting surface, the stabilizer foot 114 can be pivotally deployed downward to abut against the resting surface. The foot portions 110 and the deployed stabilizer foot 114 can thereby provide at least three contact locations for stable support of the infant bed apparatus 100 on the resting surface. The stabilizer foot 114 when unused can be stowed over the housing 108.

The bed frame 104 can include two tube segments 116 that run along two sides of the lengthwise axis X, and have two opposite portions 104A and 104B respectively coupled with the two housings 106 and 108. The tube segments 116 can be made of various rigid or semi-rigid materials from which a bed 118 comprised of soft goods can be suspended to form a hammock-like environment for placement of the child. The housing 106 coupled with the first portion 104A can be proximate to a foot region of the bed frame 104 (i.e., near the feet of a child placed in the bed 118), and the housing 108 coupled with the second portion 104B can be proximate to a head region of the bed frame 104 (i.e., near the head of the child placed in the bed 118).

The first portion 104A of the bed frame 104 can be anchored with the housing 106 via a coupling assembly 120. The coupling assembly 120 can restrainedly position the first portion 104A with the housing 106, but still allows relative movement between the first portion 104A and the housing 106, in particular a rotational displacement of the first portion 104A of the bed frame 104 about the housing 106.

In the embodiment shown in FIGS. 1 and 2, the coupling assembly 120 can be exemplary implemented as a pivotal connection. The pivotal connection can include a sleeve portion 122A through which the two tube segments 116 can be affixed, and a shaft portion 122B affixed with the sleeve portion 122A and pivotally connected with the housing 106 about a pivot axis P extending substantially vertical.

Figure 7:
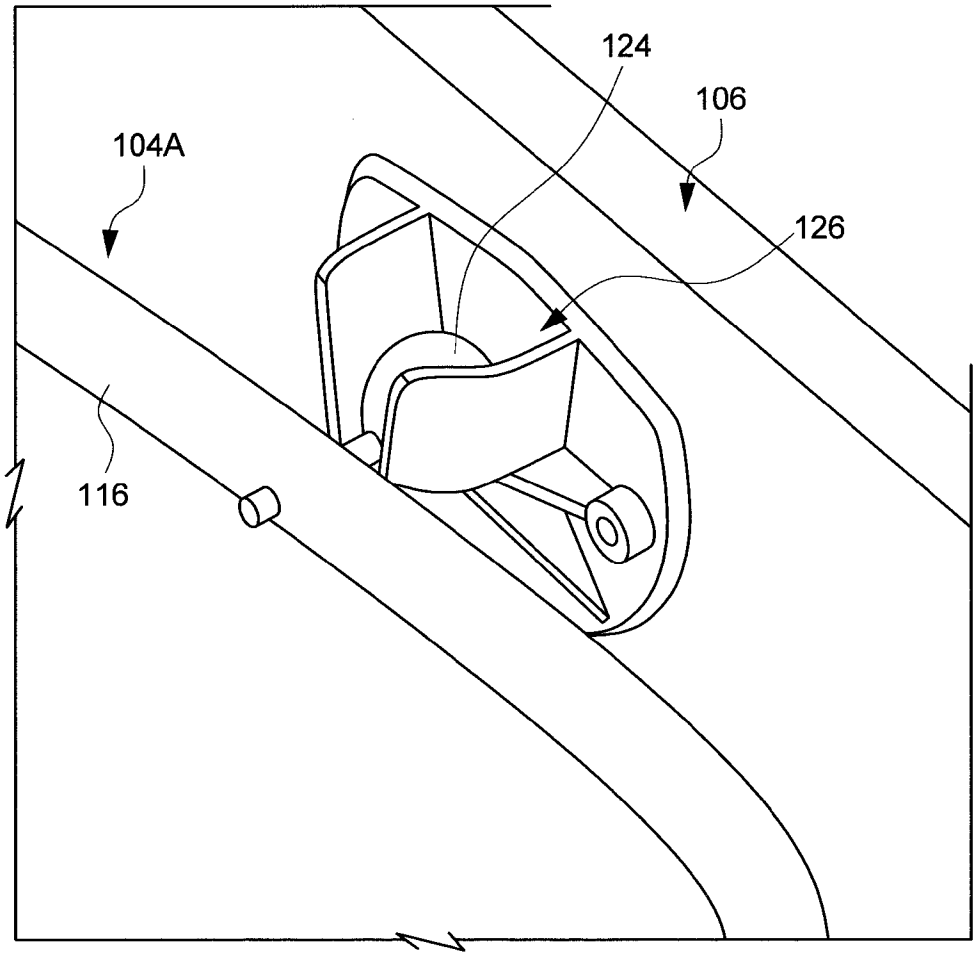
FIG. 7 is a schematic view illustrating an embodiment for anchoring a portion of the bed frame with the support frame in the infant bed apparatus.

FIG. 7 is a schematic view illustrating another embodiment for anchoring the bed frame 104 with the housing 106. The first portion 104A of the bed frame 104 can be affixed with a ball 124 that can be assembled in a recess 126 provided in the housing 106 to form a spherical joint.

Figure 8:
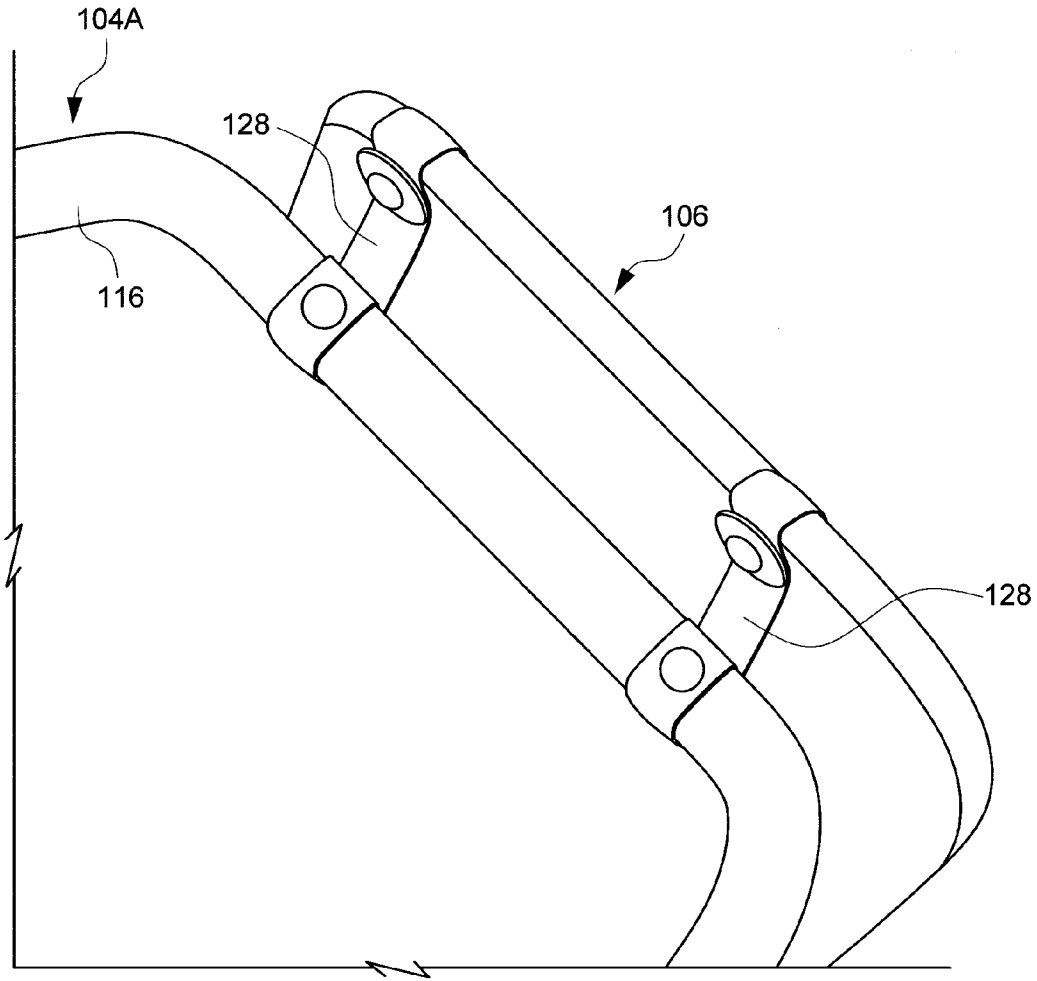
FIG. 8 is a schematic view illustrating another variant embodiment for anchoring a portion of the bed frame with the support frame in the infant bed apparatus.

FIG. 8 is a schematic view illustrating another variant embodiment for anchoring the bed frame 104 with the housing 106 via one or more webbing straps 128. A first end of the webbing strap 128 can be affixed with the first portion 104A of the bed frame 104, and a second end of the webbing strap 128 can be affixed with the housing 106, so that the first portion 104A of the bed frame 104 can suspended from the housing 106.

Figure 5:
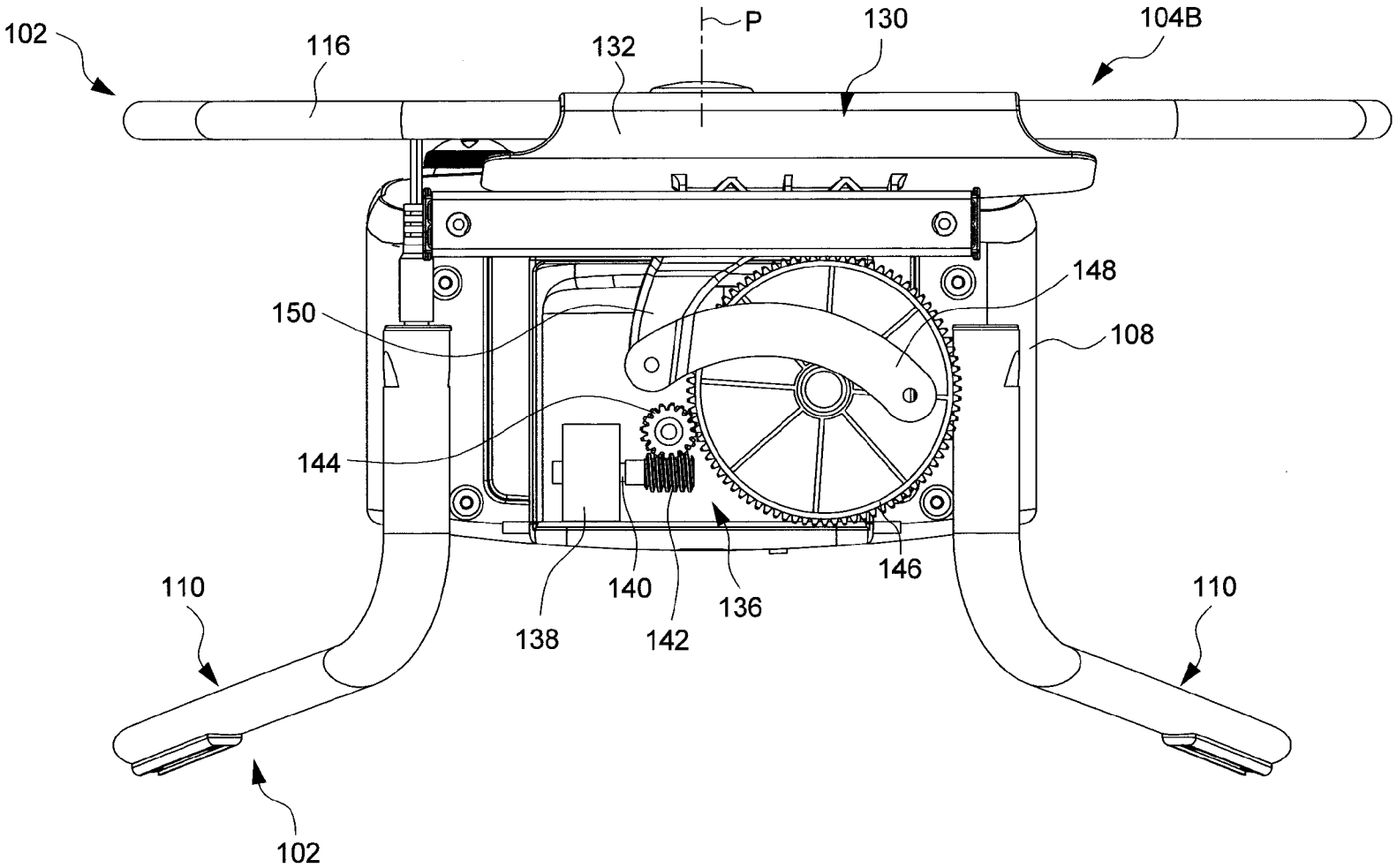
FIG. 5 is a schematic view illustrating a motorized drive unit provided in the support frame of the infant bed apparatus.
Figure 6:
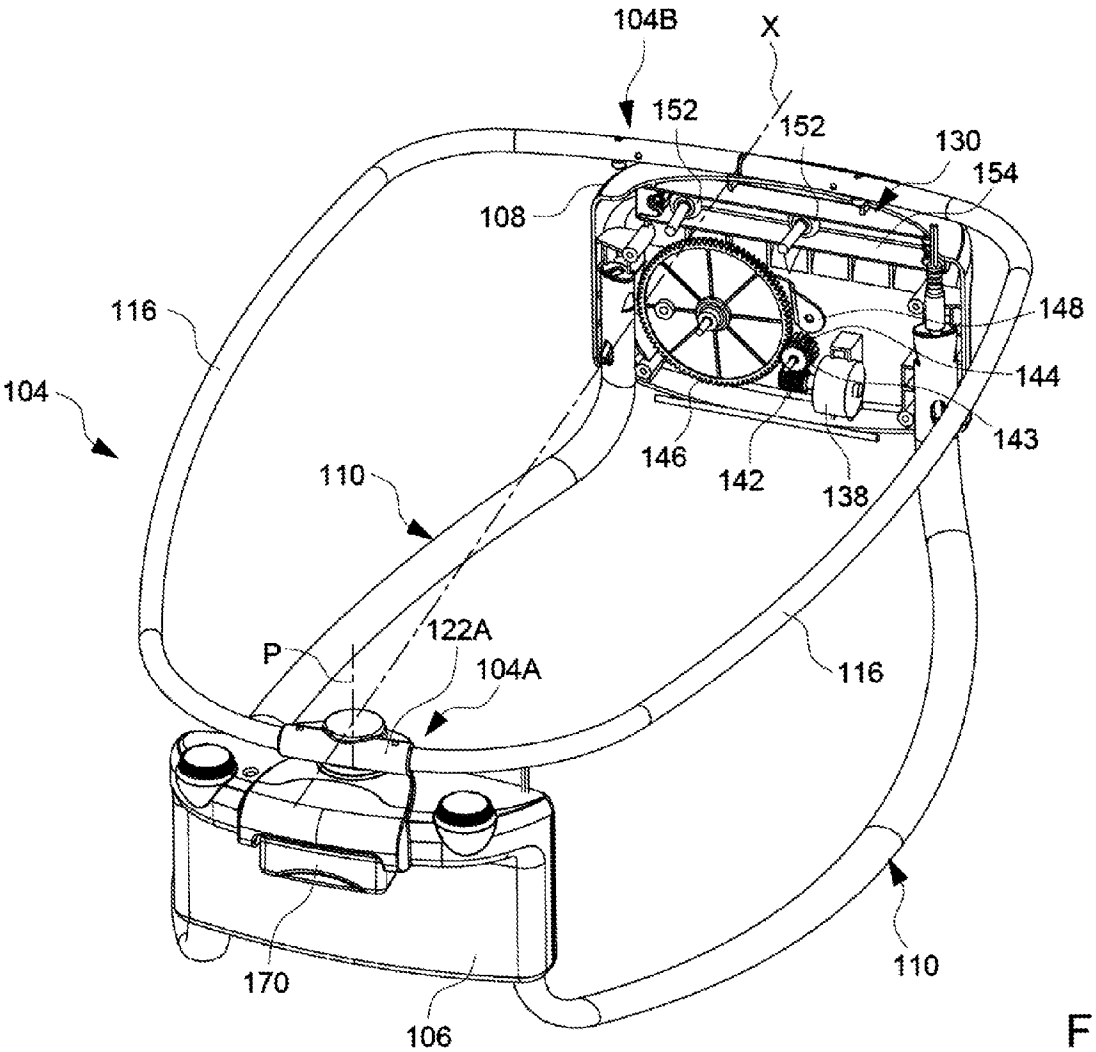
FIG. 6 is a schematic view illustrating the motorized drive unit of FIG. 5 from another perspective.
Figure 6A:
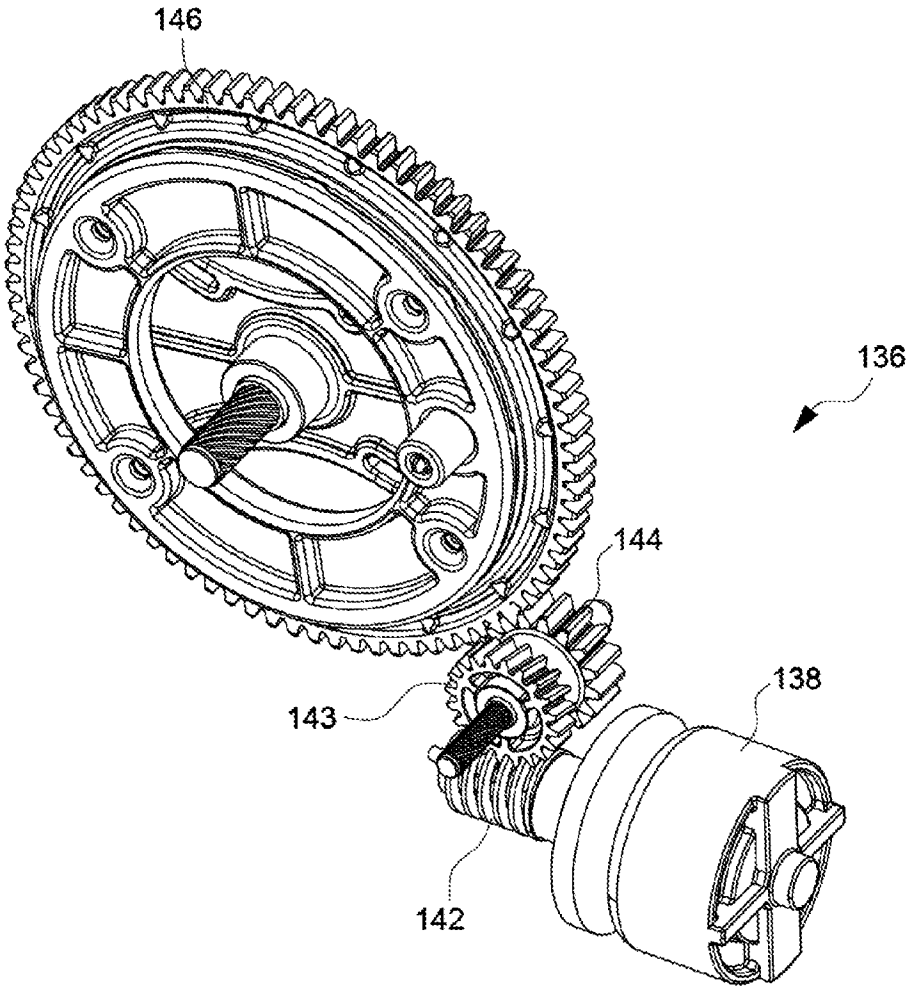
FIG. 6A is a schematic view illustrating more construction details of the motorized drive unit.

Referring again to FIGS. 1 and 2, the bed frame 104 can have a second portion 104B that is assembled with the housing 108 via a coupling member 130. The coupling member 130 can be assembled with the housing 108 for movement transversal to the lengthwise axis X so as to impart reciprocated sideways displacement of the bed frame 104 transversely to the lengthwise axis X. In one embodiment, the coupling member 130 can be formed as an elongated carriage 132 having a sleeve portion 132A through which the tube segments 116 can be affixed. The coupling member 130 can be driven in movement by a motorized drive unit 136 (better shown in FIGS. 5 and 6) disposed in the housing 108.

In conjunction with FIGS. 1-3, FIGS. 5, 6 and 6A are schematic views illustrating an interior of the housing 108 where is assembled the motorized drive unit 136. The motorized drive unit 136 can include an electric motor 138 having an output shaft 140, a worm 142, a worm gear 143, two spur gears 144 and 146, and a linkage rod 148.

Examples of the electric motor 138 can include a DC motor. The worm 142 can be fixedly connected with the output shaft 140 of the electric motor 138, and can rotate in unison with the output shaft 140. In one embodiment, the common axis of the output shaft 140 and the worm 142 can be substantially orthogonal to the lengthwise axis X and extend transversally. The worm gear 143 and the spur gear 144 can be coaxially connected with each other so as to form an integral gear set. The worm gear 143 is meshed with the worm 142, and rotation of the worm 142 can cause synchronous rotation of the worm gear 143 and the spur gear 144. The spur gear 144 can mesh with the spur gear 146. The spur gear 144 can have a smaller diameter than the diameter of the spur gear 146. The linkage rod 148 can have a first end pivotally connected with an eccentric point of the spur gear 146, and a second end pivotally connected with an arm 150 of the coupling member 130 projecting downward in the interior of the housing 108. This construction of the motorized drive unit 136 can be compactly arranged in the housing 108.

A continuous rotation of the electric motor 138 can be converted through the worm 142, the worm gear 143, the spur gears 144 and 146 and the linkage rod 148 into reciprocated movement of the coupling member 130 transversal to the lengthwise axis X. For facilitating the displacement of the coupling member 130, the coupling member 130 may be assembled with a plurality of wheels 152 in rolling contact with a guide track 154 provided in the housing 108 (better shown in FIG. 6). In one embodiment, the guide track 154 may have a relatively flat surface, so that the coupling member 130 can move in a substantially horizontal plane that is substantially perpendicular to the pivot axis P. In another embodiment, the guide track 154 may also have a wave pattern so as to impart a spatial motion to the coupling member 130 that includes a horizontal component parallel to a horizontal plane, and a vertical component parallel to the pivot axis P. For facilitating the spatial motion of the second portion 104B of the bed frame 104 and the coupling member 130 to which it is connected, the connection between the housing 106 and the first portion 104A of the bed frame 104 may be configured to permit an additional degree of freedom in addition to the rotation about the pivot axis P, e.g., by allowing relative rotation between the first portion 104A and the sleeve portion 122A shown in FIGS. 1 and 2 about a horizontal axis, or by using any of the anchorage shown in FIGS. 7 and 8. Accordingly, the bed frame 104 can swing sideways relative to the support frame 102, transversally to the lengthwise axis X about the anchorage of the first portion 104A with the housing 106.

Figure 9:
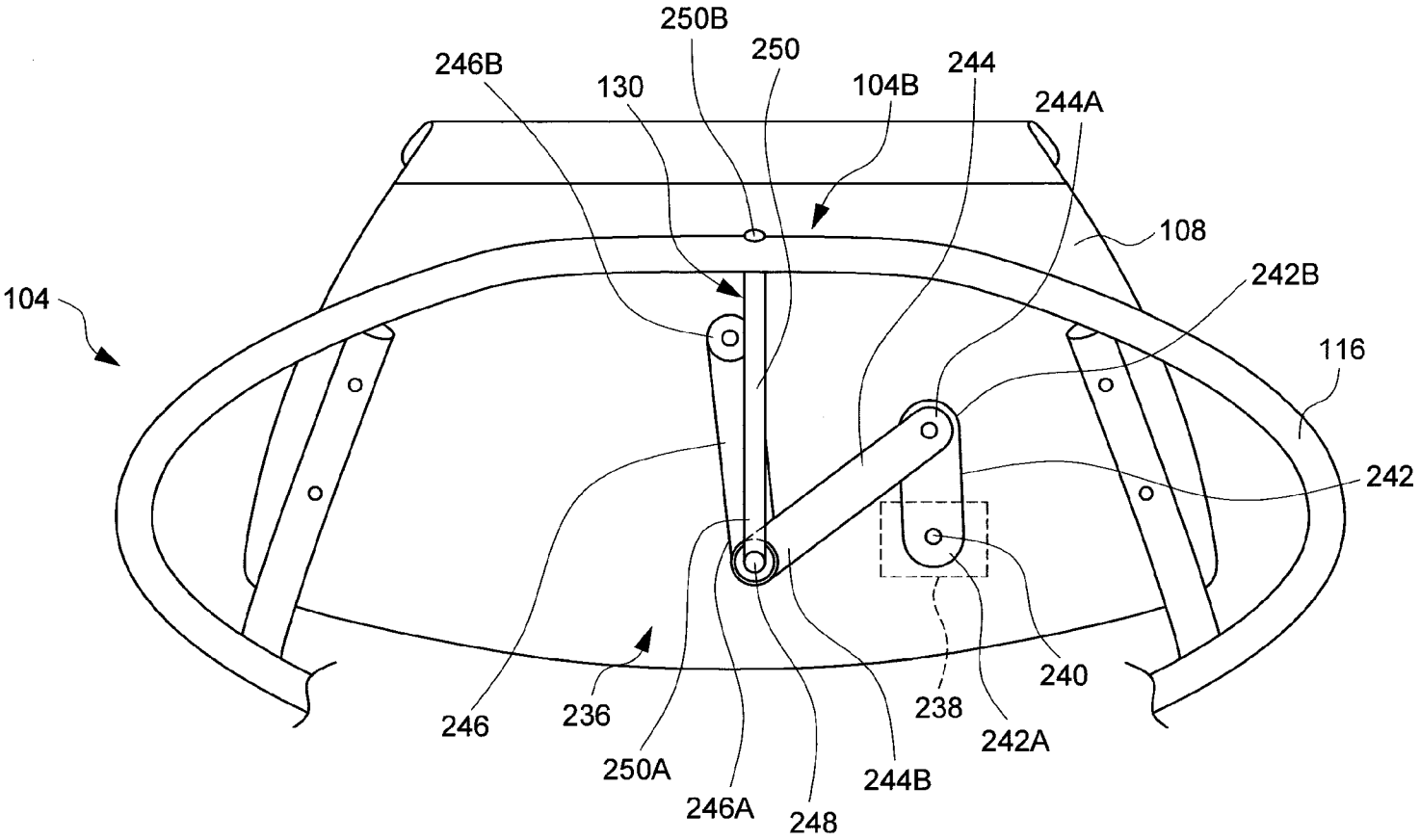
FIG. 9 is a schematic view illustrating another embodiment of a motorized drive unit provided in the support frame of the infant bed apparatus.

FIG. 9 is a schematic view illustrating another possible embodiment of a motorized drive unit 236 for driving movement of the second portion 104B of the bed frame 104. The motorized drive unit 236 can include an electric motor 238 (shown with phantom lines) having an output shaft 240, a crank 242 having two opposite ends 242A and 242B, a bar linkage 244 having two opposite ends 244A and 244B, and another bar linkage 246 having two opposite ends 246A and 246B. The end 242A of the crank 242 can be connected with the output shaft 240, and the end 242B can be pivotally connected with the end 244A of the bar linkage 244. The end 244B of the bar linkage 244 can be pivotally connected with the end 246A of the bar linkage 246 via a pivot shaft 248, and the end 246B of the bar linkage 246 can be pivotally connected with the housing 108. The pivot shaft 248 can extend substantially horizontal and substantially parallel to the output shaft 240 of the electric motor 238.

An elongated rod 250 can act as the coupling member 130 having two ends 250A and 250B. The end 250A of the elongated rod 250 can be pivotally connected with the pivot shaft 248, and the end 250B can be connected with the second portion 104B of the bed frame 104. The crank 242, the bar linkages 244 and 246 and the coupling member 130 can extend substantially vertical and perpendicular to the pivot shaft 248.

A continuous rotation of the electric motor 238 can be converted into a periodical vertical and horizontal motion of pivot shaft 248 and the elongated rod 250. As a result, the elongated rod 250 can impart a reciprocated displacement to the second portion 104B of the bed frame 104 having a horizontal component and a vertical component. To accommodate the sideways and vertical motion driven by the elongated rod 250, any of the connection structures described previously may be implemented to anchor the first portion 104A of the bed frame 104 with the housing 106, e.g., the coupling assembly 120 as illustrated in FIGS. 1 and 2 (with the addition of another degree of freedom to facilitate vertical displacement of the second portion 104B of the bed frame 104), the spherical joint as illustrated in FIG. 7 or the webbing strap as illustrated in FIG. 8. Accordingly, the bed frame 104 can swing sideways transversal to the lengthwise axis X about the anchorage of the first portion 104A with the housing 106. This swing motion can include a horizontal component and a vertical component of the second portion 104B of the bed frame 104.

Figure 10:
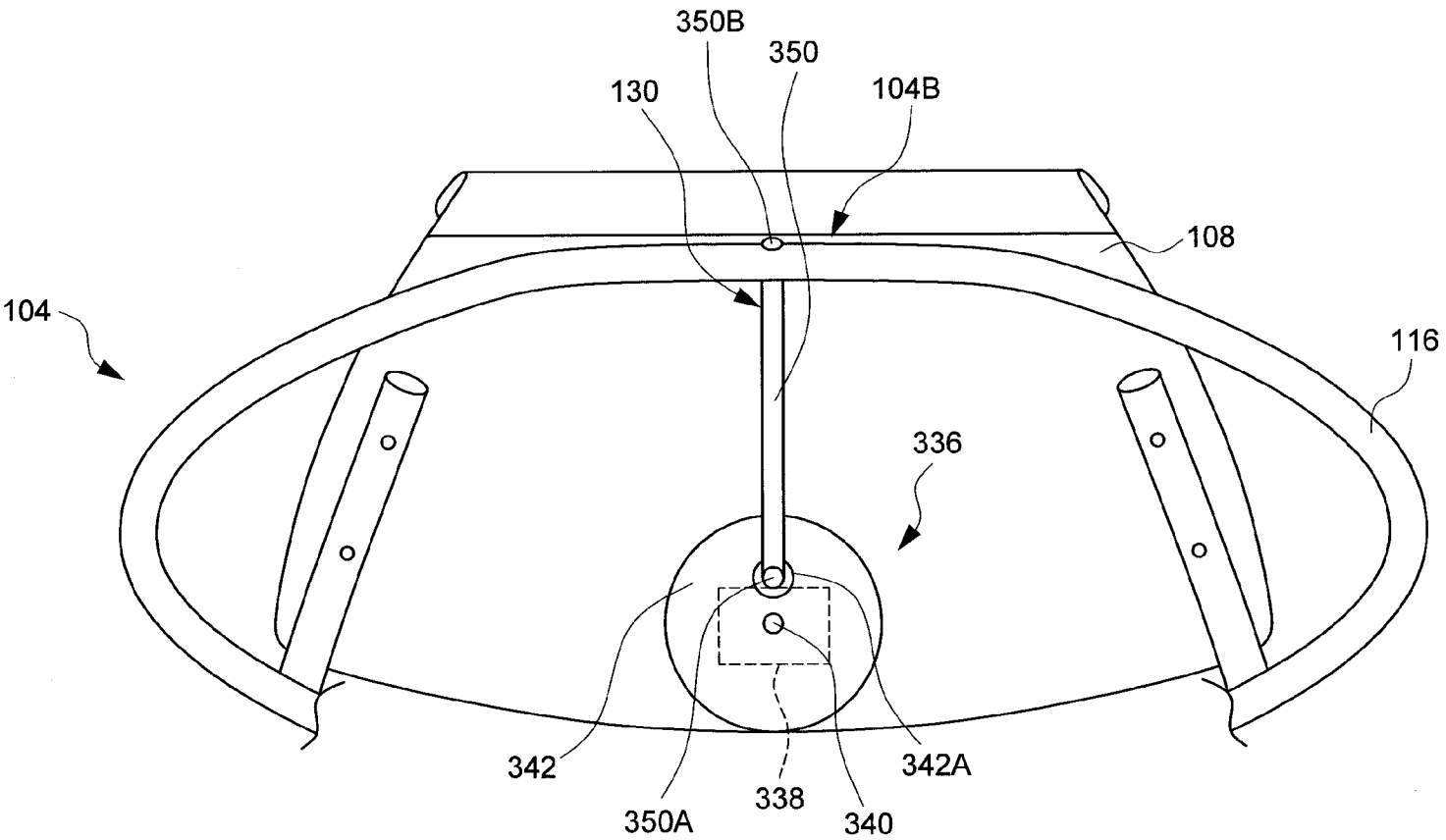
FIG. 10 is a schematic view illustrating another variant embodiment of a motorized drive unit provided in the support frame of the infant bed apparatus.

FIG. 10 is a schematic view illustrating another variant embodiment of a motorized drive unit 336 for driving movement of the second portion 104B of the bed frame 104. The motorized drive unit 336 can include an electric motor 338 having an output shaft 340, and a crank 342 having an eccentric portion 342A. The crank 342 can be affixed with the output shaft 340 and rotate therewith. An elongated rod 350 can act as the coupling member 130 having two ends 350A and 350B. The end 350A of the elongated rod 350 can be pivotally connected with the crank 342, and the end 350B can be connected with the second portion 104B of the bed frame 104. Likewise, a continuous rotation of the electric motor 338 can be converted into a periodical vertical and horizontal motion of the elongated rod 250 that consequently can impart a reciprocated displacement to the second portion 104B of the bed frame 104 having a horizontal component and a vertical component.

The motorized drive units as described previously can be powered by a power source that is incorporated in the support frame 102. Referring again to FIG. 1, a power source 160 can be provided in the housing 106 to supply power for the motorized drive unit 136. The power source 160 may include battery cells that are disposed in a battery compartment inside the housing 106. The power source 160 can be electrically connected with the motorized drive unit 136 via a wiring 162 that is routed through the support frame 102. In the illustrated embodiment, the wiring 162 can be exemplary routed through one of the foot portions 110 from the housing 106 to the housing 108.

In one configuration of use, the infant bed apparatus 100 can be used independently on a resting surface, the support frame 102 resting in contact on the resting surface for providing support. In another configuration of use, the infant bed apparatus 100 can be used in combination with a play yard. For facilitating the installation of the infant bed apparatus 100 on a play yard, the infant bed apparatus 100 can include a plurality of latches 170 and 172 operable to fasten the infant bed apparatus 100 to a play yard.

Figure 11:
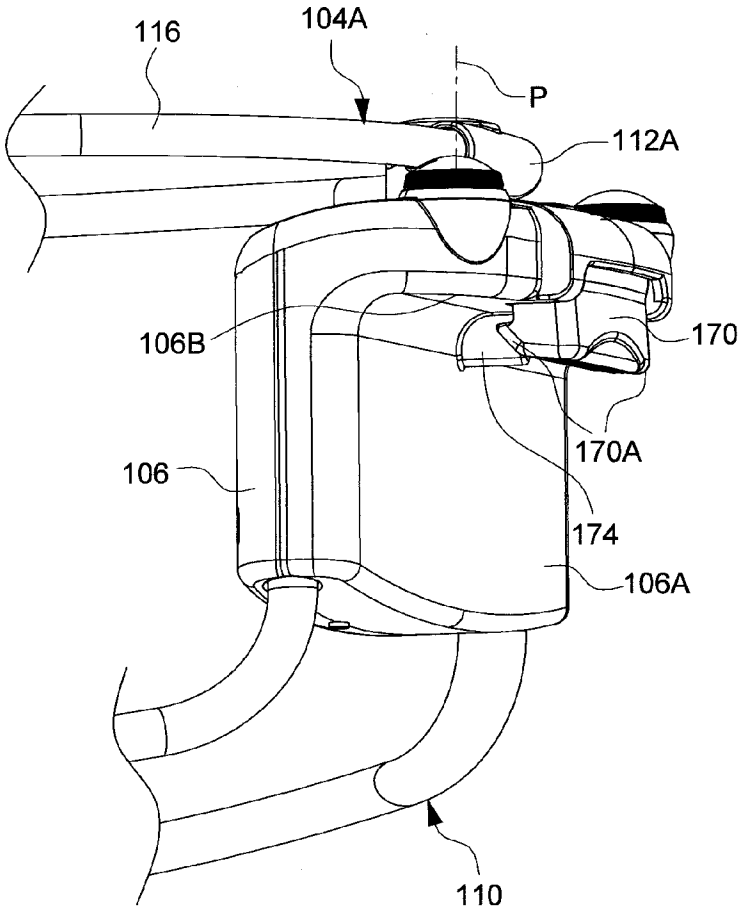
FIG. 11 is a schematic view illustrating a portion of the infant bed apparatus shown in FIG. 1 provided with a first latch operable to fasten the infant bed apparatus to one side of a play yard.
Figure 12:
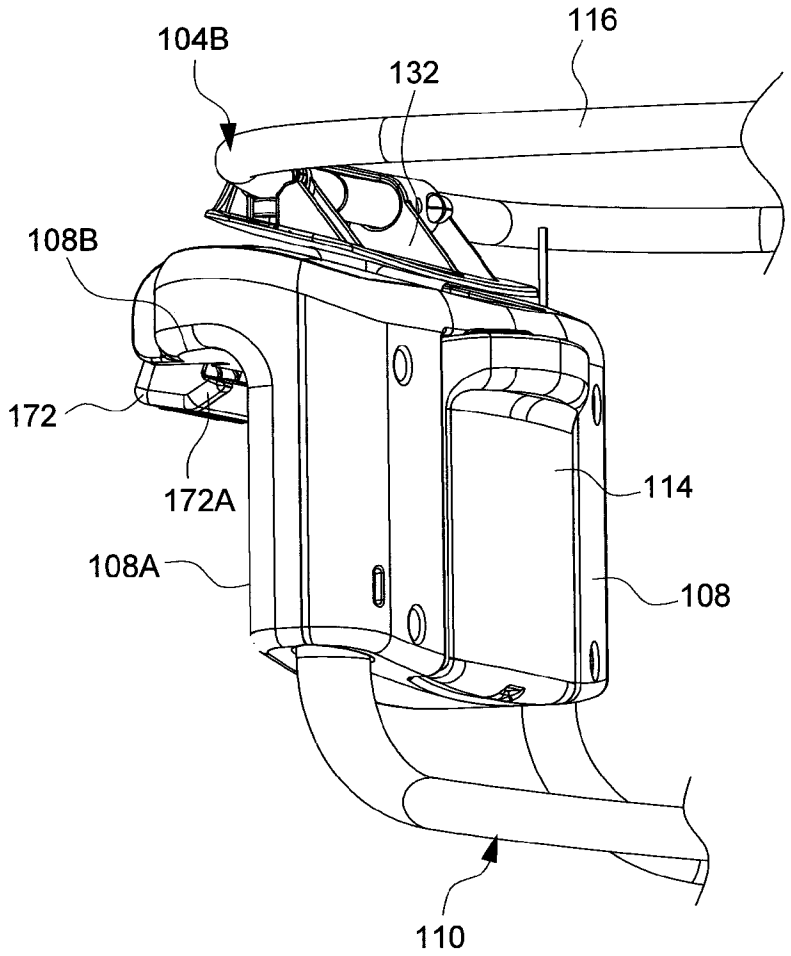
FIG. 12 is a schematic view illustrating another portion of the infant bed apparatus shown in FIG. 1 provided with a second latch operable to fasten the infant bed apparatus to another opposite side of a play yard.

In conjunction with FIG. 1, FIGS. 11 and 12 are enlarged views illustrating the housings 106 and 108 respectively provided with the latch 170 and 172 operable to fasten the infant bed apparatus 100 to a play yard. The housing 106 can have an outer side surface 106A extending vertically and facing an outside of the infant bed apparatus 100, and a downwardly facing surface 106B projecting outward from the outer side surface 106A. The latch 170 can be pivotally connected with the downwardly facing surface 106B, and include two hook portions 170A horizontally spaced apart from each other. A spring (not shown) may be assembled in the housing 106 to rotationally bias the latch 170 toward a locking state. The outer side surface 106A of the housing 106 can include a protrusion 174 disposed in a region between the two hook portions 170A of the latch 170 and below the downwardly facing surface 106B.

Likewise, the housing 108 can have an outer side surface 108A extending vertically and facing an outside of the infant bed apparatus 100, and a downwardly facing surface 108B projecting outward from the outer side surface 108A. The latch 172 can be pivotally connected with the downwardly facing surface 108B, and include two hook portions 172A horizontally spaced apart from each other. A spring (not shown) may also be assembled in the housing 108 to rotationally bias the latch 172 toward a locking state. The outer side surface 108A of the housing 108 can likewise include a similar protrusion 174 disposed in a region between the two hook portions 172A of the latch 172 and below the downwardly facing surface 108B.

Figure 13:
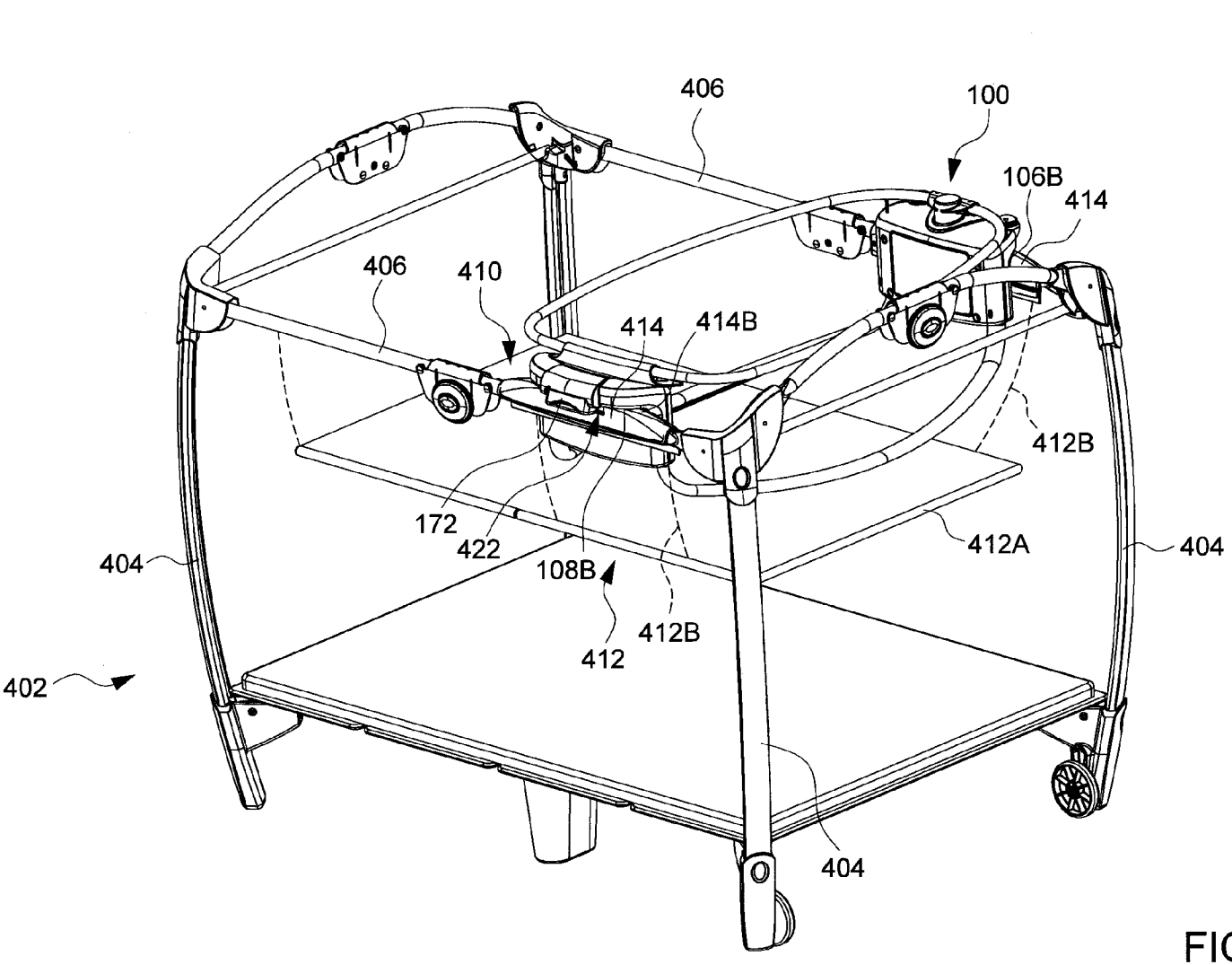
FIG. 13 is a schematic view illustrating the infant bed apparatus of FIG. 1 installed on a play yard.
Figure 14:
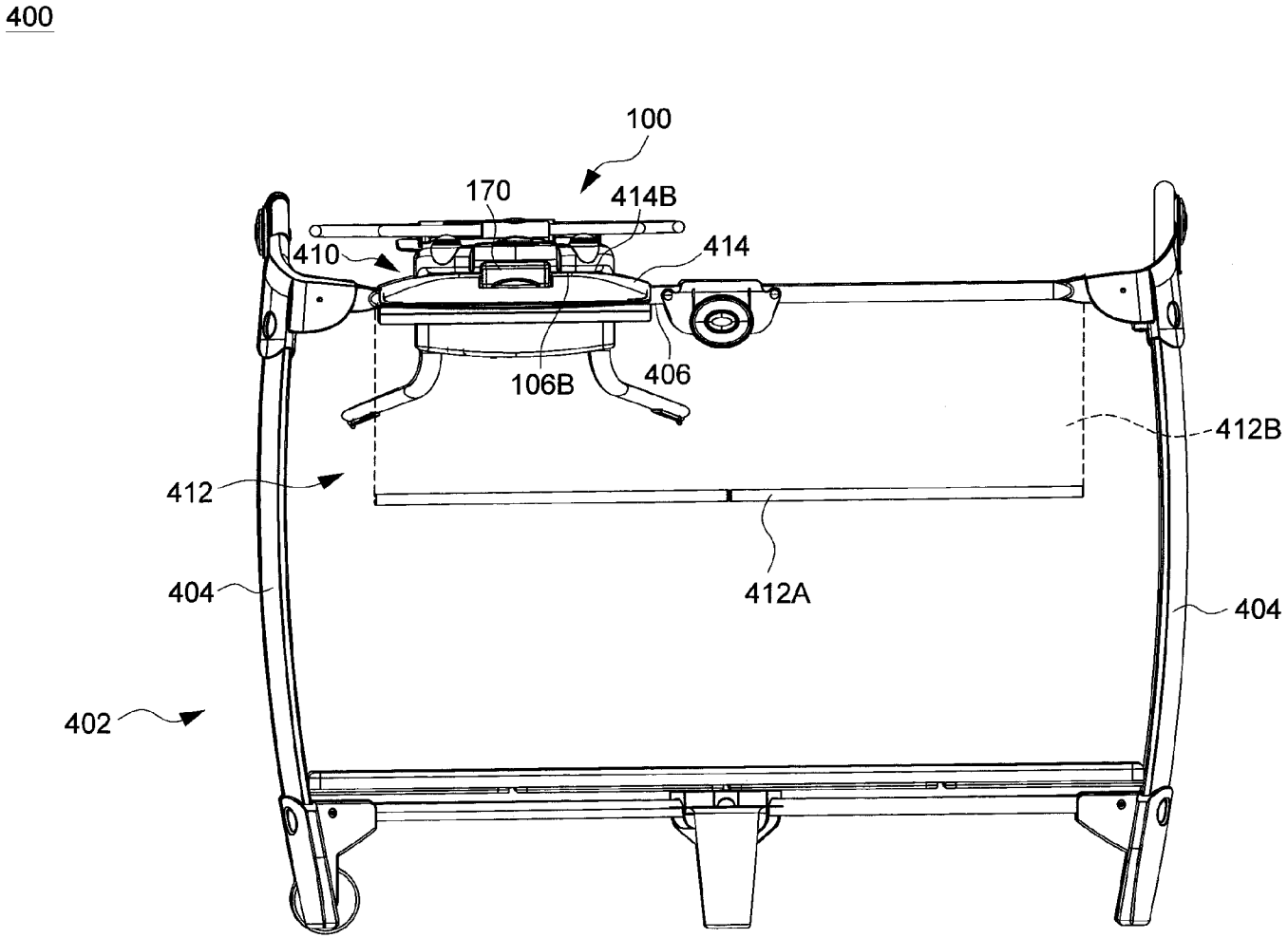
FIG. 14 is a side view illustrating the combination of the infant bed apparatus with the play yard shown in FIG. 13.

FIGS. 13 and 14 are respectively perspective and side views illustrating a play yard 400 installed with the infant bed apparatus 100. The play yard 400 can include a rigid frame 402 including upright legs 404, and two assemblies of side tube segments 406 connected with upper ends of the upright legs 404 at two opposite sides of the frame 402. The frame 402 can further include an attachment structure 410 used for holding a bassinet 412 in the interior of the play yard 400. In one embodiment, the attachment structure 410 can include two clipping members 414 that can respectively clamp on the two side tube segments 406. The bassinet 412 can include a bottom board 412A, and sidewalls 412B respectively connected with the bottom board 412A and the clipping members 414. The clipping members 414 can thereby hold the bottom board 412A suspended from the side tube segments 406 of the play yard 400.

Figure 15:
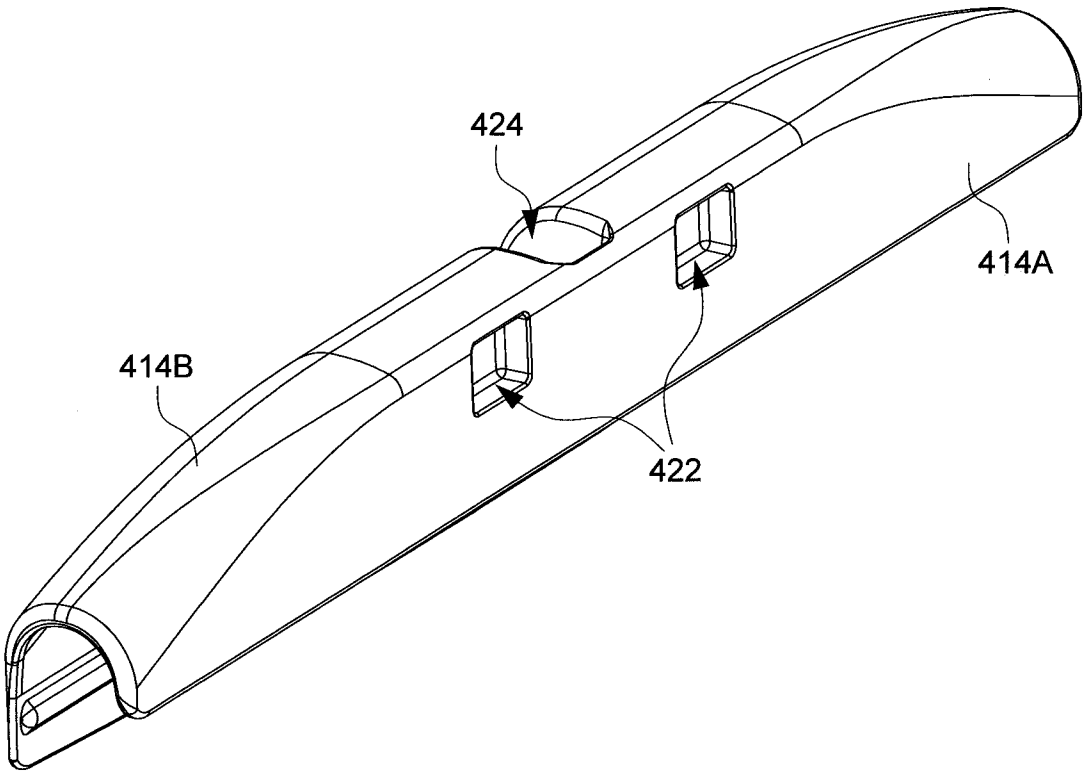
FIG. 15 is perspective view illustrating a clipping member used in an attachment structure for holding a bassinet with a play yard.
Figure 16:
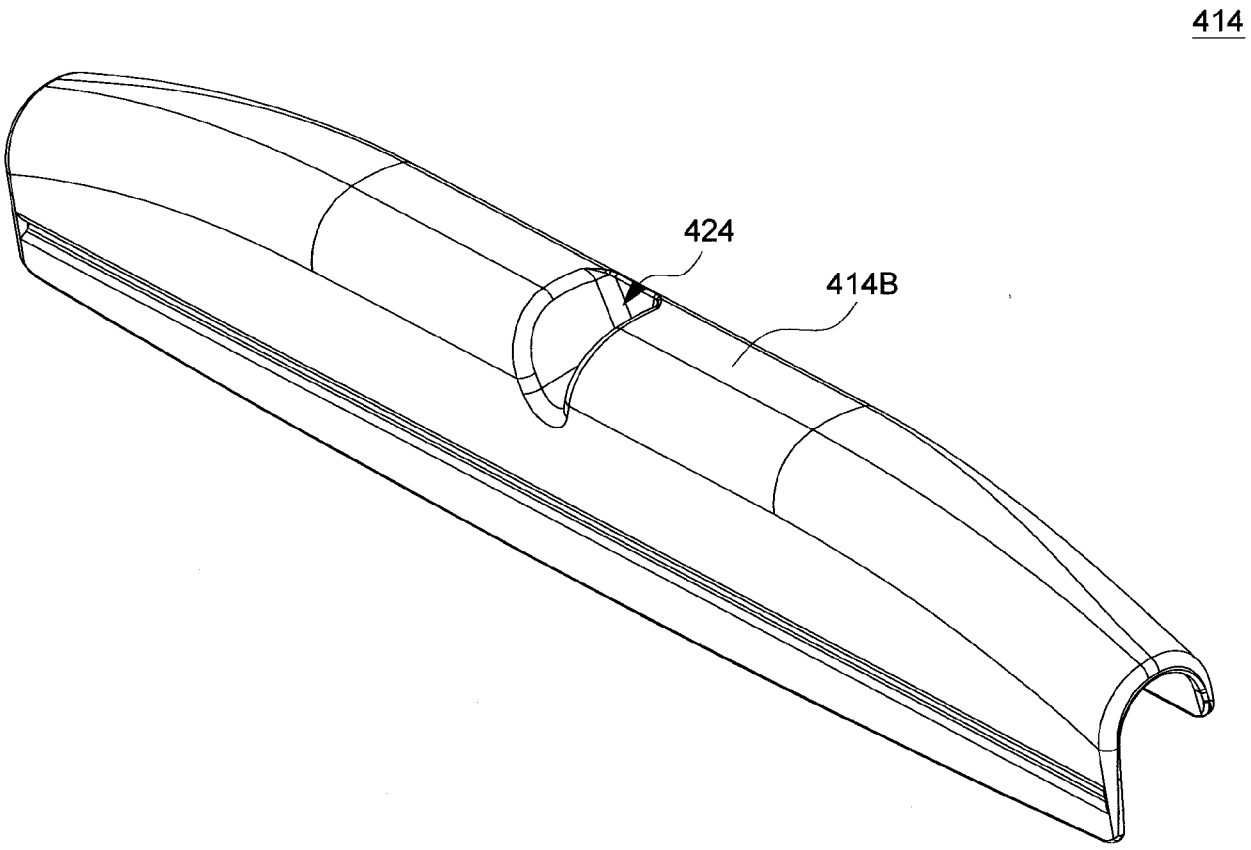
FIG. 16 is another perspective view of the clipping member shown in FIG. 15.

FIGS. 15 and 16 are schematic views illustrating one clipping member 414. The clipping member 414 can be formed in an integral body having an outer side surface 414A, and an upper surface 414B contiguous to the outer side surface 414A. The outer side surface 414A can have two recesses 422 horizontally spaced apart from each other, and the upper surface 414B can have a recess 424 disposed in a region between the two recesses 422.

When the infant bed apparatus 100 is installed on the play yard 400, the downwardly facing surfaces 106B and 108B of the housings 106 and 108 can respectively rest on the upper surfaces 414B of the two clipping members 414 such that each protrusion 174 can respectively mate complementarily with the corresponding recess 424. Moreover, the hook portions 170A and 172A of the latches 170 and 172 can respectively engage with the recesses 422 of the two clipping member 414 to block upward removal of the infant bed apparatus 100. The mating arrangement of each protrusion 174 with the recess 424 can prevent erroneous installation of the infant bed apparatus 100. If the protrusions 174 are positioned anywhere else other than in the recesses 424 of the clipping members 414 (e.g., on the side tube segments 406), the infant bed apparatus 100 will not be able to rest in a stable manner. Therefore, the aforementioned arrangement can provide an safety design that can effectively alert the caregiver when the infant bed apparatus 100 is not placed in a right position. The infant bed apparatus 100 can be thereby safely affixed on the play yard 400.

The aforementioned construction of the latches 170 and 172 and the protrusions 174 is such that the infant bed apparatus 100 can be installed on the play yard 400 only when the clipping members 414 are attached on the side tube segments 406 of the play yard 400. If the clipping members 414 are not present, the protrusions 174 would rest unstably on the side tube segments 406, and the infant bed apparatus 100 would not be able securely installed on the play yard 400. In other words, installation of the infant bed apparatus 100 is possible only once the bassinet 412 has been assembled with the play yard 400. Accordingly, erroneous installation of the infant bed apparatus 100 on the play yard 400 can be prevented.

It is worth noting that wile the housings 106 and 108 have been described as being attachable with the clipping members of a bassinet, any attachment structure provided with features similar to the clipping members 414 (e.g., provided with the recesses 422 and 424) may be disposed on the side tube segments 406 of the play yard 400 for direct attachment of the housings 106 and 108 thereto.

Figure 17:
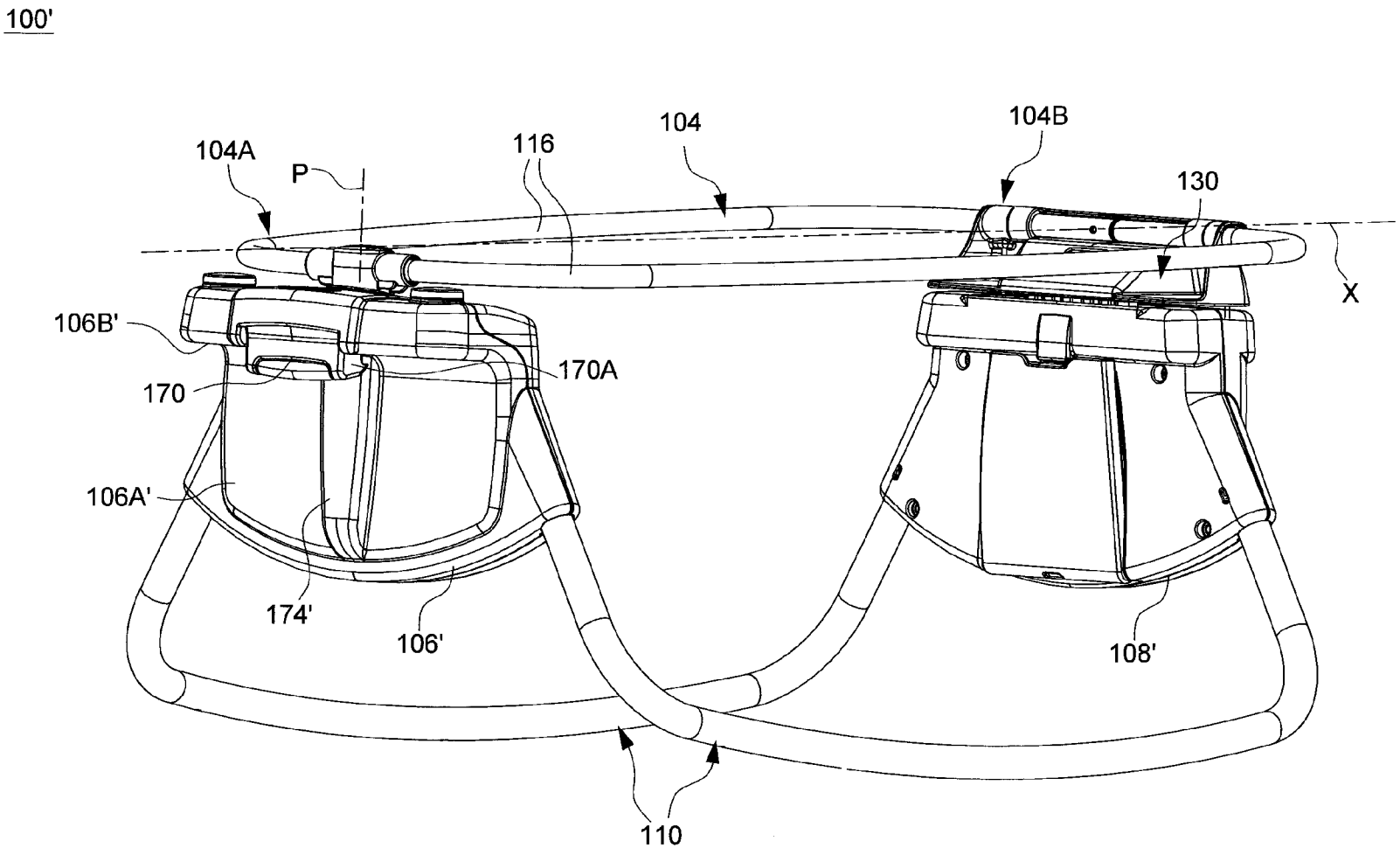
FIG. 17 is a perspective view illustrating another embodiment of an infant bed apparatus provided with latches for installing the infant bed apparatus on a play yard.
Figure 18:
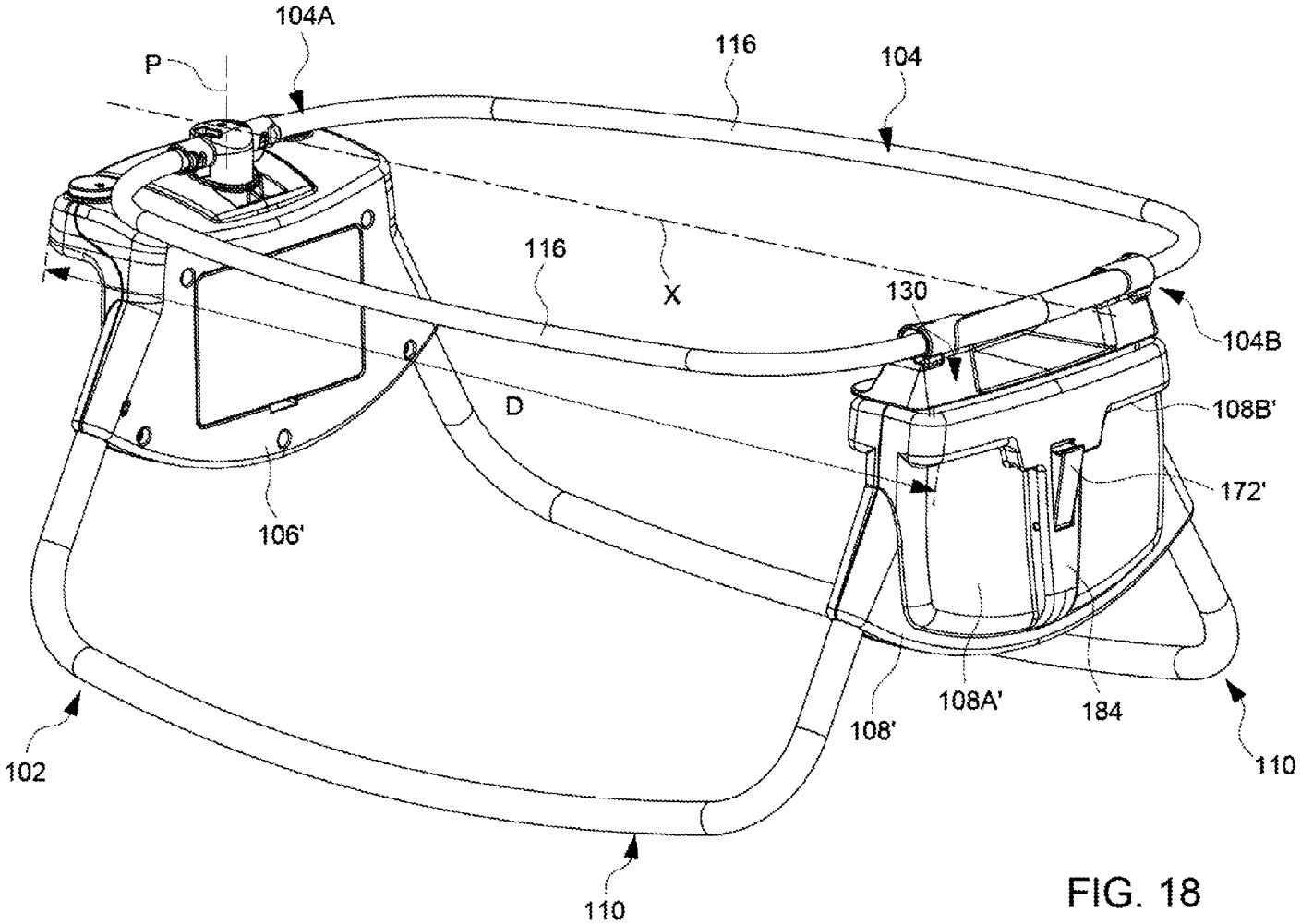
FIG. 18 is another perspective view of the infant bed apparatus shown in FIG. 17.

FIGS. 17 and 18 are schematic views illustrating another embodiment of a latch mechanism adapted to fasten an infant bed apparatus 100' with the play yard 400. Like previously described, the infant bed apparatus 100' can include two housings 106' and 108' disposed on the lengthwise axis X respectively adjacent to the first and second portions 104A and 104B of the bed frame 104. The first portion 104A of the bed frame 104 can be movably anchored with the housing 106', and the second portion 104B can be affixed with the coupling member 130 and oscillate sideways transversal to the lengthwise axis X.

The housing 106' can have an outer side surface 106A' extending vertically and facing an outside of the infant bed apparatus 100, and a downwardly facing surface 106B' projecting outward from the outer side surface 106A'. The latch 170 can be pivotally connected with the downwardly facing surface 106B', and include two hook portions 170A horizontally spaced apart from each other. The latch 170 can be biased by a spring (not shown) assembled in the housing 106' toward a locking state. The outer side surface 106A' of the housing 106' can also include a protrusion 174' disposed in a region between the two hook portions 170A of the latch 170 and below the downwardly facing surface 106B'.

As better shown in FIG. 18, the housing 108' can have an outer side surface 108A' extending vertically and facing an outside of the infant bed apparatus 100', and a downwardly facing surface 108B' projecting outward from the outer side surface 108A'. The housing 108' can further include a protrusion 184 that projects outward from the outer side surface 108' and extends downward from the downwardly facing surface 108B' so as to form a T-shape feature. A latch 172' can be pivotally connected with the protrusion 184 below the downwardly facing surface 108B', and can be connected with a spring (not shown) assembled in the housing 108'. The latch 172' can be spring-biased outward from a substantially vertical surface of the T-shape feature, so as to extend beyond the outer rim of the downwardly facing surface 108B'.

Figure 19:
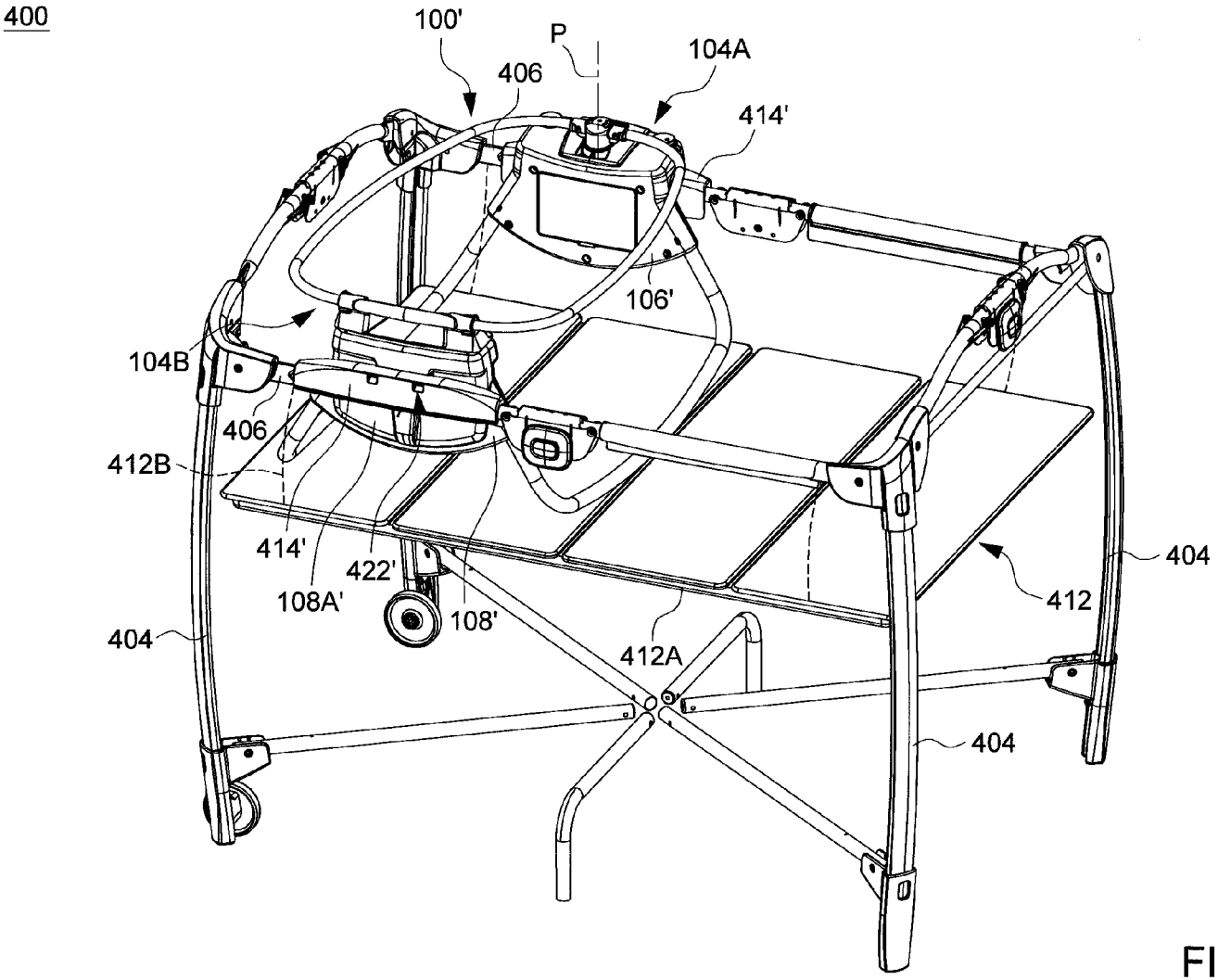
FIG. 19 is a schematic view illustrating the infant bed apparatus of FIG. 17 installed on a play yard.
Figure 20:
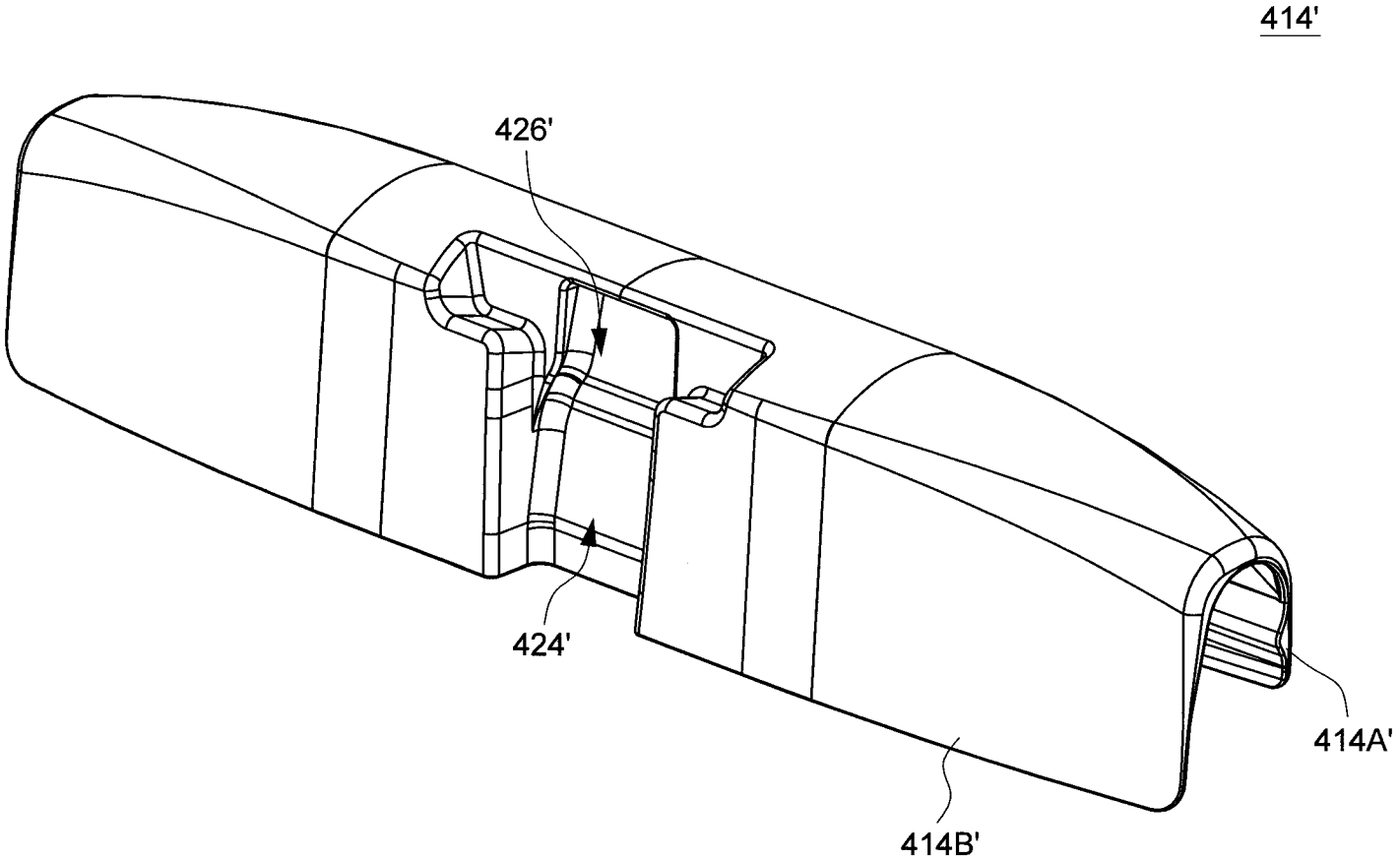
FIG. 20 is a perspective view illustrating another embodiment of a clipping member used in an attachment structure for holding a bassinet with a play yard.
Figure 21:
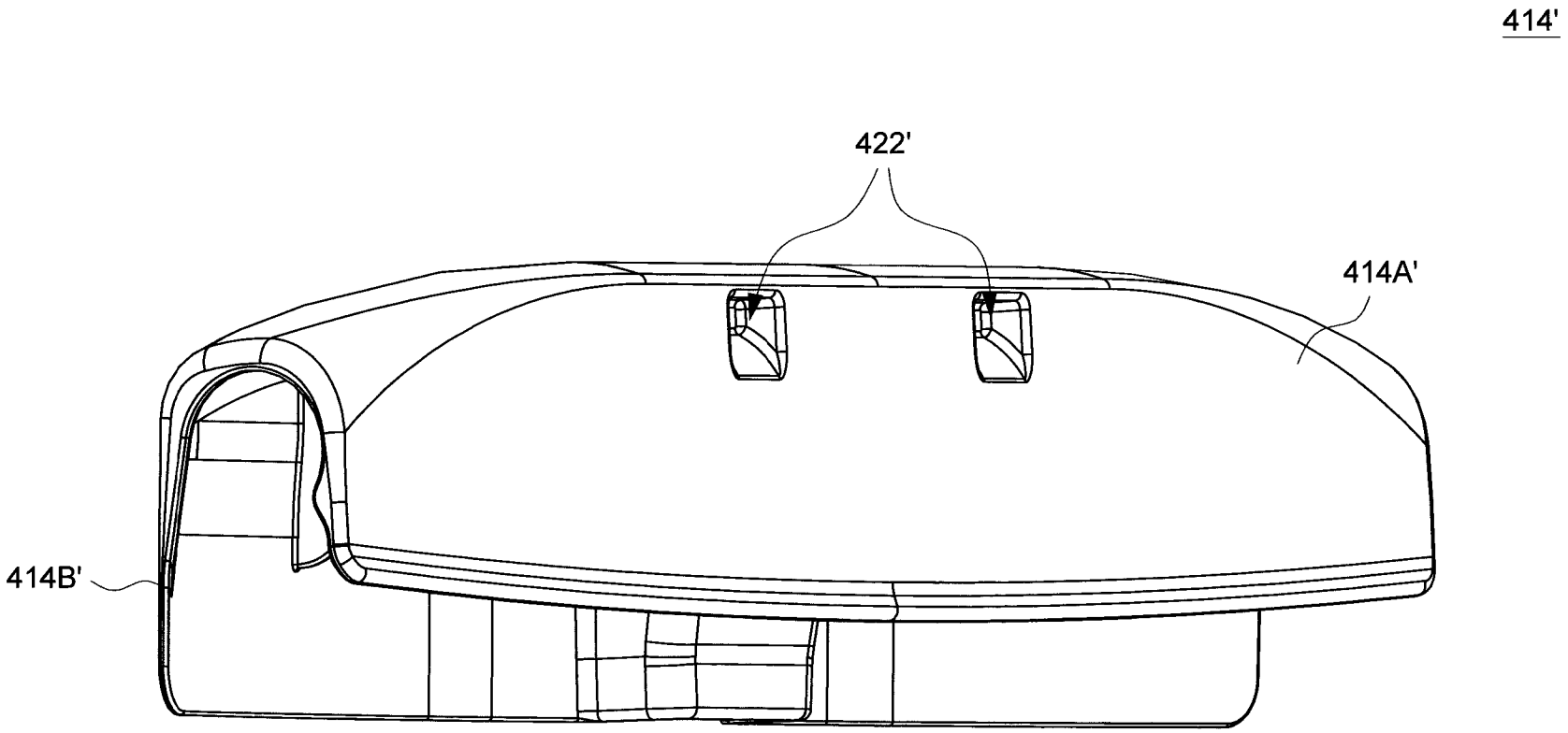
FIG. 21 is another perspective view of the clipping member shown in FIG. 20.

FIG. 19 is a perspective view illustrating a play yard 400 installed with the infant bed apparatus 100' shown in FIGS. 17 and 18, and FIG. 20 is a schematic view illustrating the construction of a clipping member 414' that can be provided on each of the two side tube segments 406 of the play yard 400. Like previously described, the two clipping members 414' can respectively clamp onto the two side tube segments 406 to suspend the bassinet 412 in the interior of the play yard 400. Each of the clipping members 414' can have an outer side surface 414A', and an inner side surface 414B' opposite to the outer side surface 414A'. The outer side surface 414A' can have two recesses 422' horizontally spaced apart from each other, and the inner side surface 414B' can have a T-shaped pocket 424' disposed in a region between the two recesses 422'. An inner sidewall of the pocket 424' can further include a recess 426'.

For installing the infant bed apparatus 100', the infant bed apparatus 100' can be lowered so that the downwardly facing surface 108B' of the housing 108' rests on one first clipping member 414', the protrusion 184 complementarily mates with the pocket 424', and the latch 172' biased by the inner spring engages with the recess 426' inside the pocket 424', whereby the housing 108' can be anchored with the first clipping member 414'. Moreover, the protrusion 174' and the latch 170 of the housing 106' can respectively engage with the recesses 424' and 422' of the second clipping member 414' to lock the housing 106' in place. The infant bed apparatus 100' can be thereby securely held with the play yard 400.

When the infant bed apparatus 100' is to be removed, the latch 170 needs to be unlocked first so that the housing 106' can be detached from the second clipping member 414'. Then the infant bed apparatus 100' can be rotated about the first clipping member 414' where the housing 108' is connected until the protrusion 174' of the housing 106' is removed from the recess 424'. The infant bed apparatus 100' then completely removed from the play yard 400.

Figure 22:
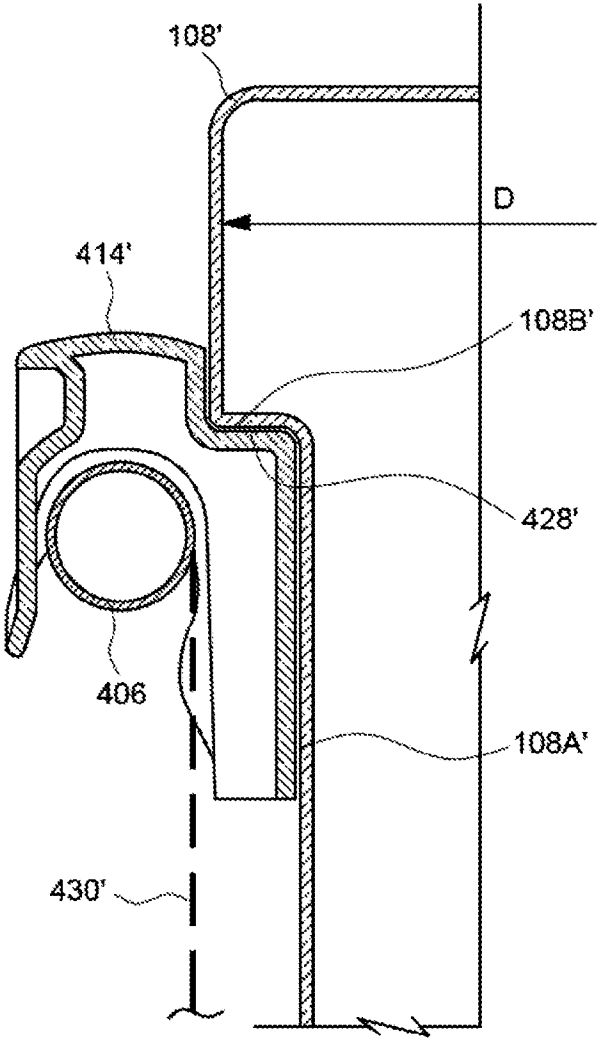
FIG. 22 is a schematic cross-sectional view illustrating one housing of the infant bed apparatus supported on the clipping member once the infant bed apparatus is properly installed on the play yard.

FIG. 22 is a schematic cross-sectional view illustrating the housing 108' supported on the clipping member 414' once the infant bed apparatus 100' is properly installed on the play yard 400. As shown, a portion of the downwardly facing surface 108B' of the housing 108' can rest against a support surface 428' of the clipping member 414' (e.g., the support surface 428' may be provided in the T-shaped pocket 424'). The support surface 428' can be located at an inner side of the tube segment 406 (the inner side of the tube segment faces an interior of the play yard 400), such that the contact area between the support surface 428' and the downwardly facing surface 108B' is offset inward from the tube segment 406 and is located in the interior of the play yard 400 defined by a fabric panel 430' that is upwardly connected with the tube segment 406 and expands between two upright legs 404. With this construction, the downwardly facing surface 108B' of the housing 108' cannot find proper support if the clipping member 414' is not installed on the tube segment 406, and the installation of the infant bed apparatus 100' would fail. Moreover, a maximum distance D between the two housings 106' and 108' taken parallel to the lengthwise axis X (better shown in FIGS. 18 and 22) can also be set smaller than a transversal distance between the tube segments 406 on the two opposite sides of the frame 402. Therefore, when the clipping member 414' is not installed, the housing 108' may even fall at the inside of the play yard 400, and proper installation of the infant bed apparatus 100' is not possible. It is noted that the same arrangement can be provided for the housing 106' and the other clipping member 414' on the opposite side. The aforementioned arrangement can accordingly prevent installation of the infant bed apparatus 100' without the presence of the clipping member 414', which can provide safer use.

As previously described, while the housings 106' and 108' have been described as being attachable with the clipping members of a bassinet, any attachment structure provided with features similar to the clipping members 414' may also be disposed on the side tube segments 406 of the play yard 400 for direct attachment of the housings 106' and 108' thereto.

Advantages of the infant bed apparatuses described herein include the ability to provide a variety of motions to help calming and soothing a child. Moreover, the infant bed apparatuses can be provided with latch systems that allow convenient installation on a play yard. Accordingly, the infant bed apparatuses can be used either independently or in combination with a play yard.

Realizations of the infant bed apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant bed apparatus comprising:

a support frame including a first and a second housing disposed at two locations spaced-apart from each other;

a bed frame defining an interior space suitable for receiving a child, the bed frame having a first portion anchored with the first housing, and a second portion assembled with the second housing, the first portion of the bed frame being rotatable relative to the first housing about a pivot axis that extends substantially vertical; and a motorized drive unit operable to drive the second portion in translational movement relative to the second housing.

2. The infant bed apparatus according to claim 1, wherein the motorized drive unit is disposed in the second housing.

3. The infant bed apparatus according to claim 1, wherein the first housing is located proximate to a foot region of the bed frame, and the second housing is located proximate to a head region of the bed frame.

4. The infant bed apparatus according to claim 1, wherein the first housing includes a power source for supplying electric power to the motorized drive unit.

5. The infant bed apparatus according to claim 4, wherein the motorized drive unit is disposed in the second housing, and the power source is electrically connected with the motorized drive unit via a wiring that is routed through the support frame.

6. The infant bed apparatus according to claim 1, wherein the first portion of the bed frame is pivotally connected with the first housing about the pivot axis that extends substantially vertical.

7. The infant bed apparatus according to claim 1, wherein the first portion of the bed frame is anchored with the first housing via a spherical joint.

8. The infant bed apparatus according to claim 1, wherein the first portion of the bed frame is anchored with the first housing via a webbing strap.

9. The infant bed apparatus according to claim 1, wherein the second portion is assembled with the second housing via a coupling member, and the motorized drive unit is operable to cause a movement of the coupling member in a substantially horizontal plane.

10. The infant bed apparatus according to claim 1, wherein the second portion is assembled with the second housing via a coupling member, and the motorized drive unit is operable to cause a spatial motion of the coupling member that includes a horizontal component and a vertical component.

11. The infant bed apparatus according to claim 1, wherein the second portion is assembled with the second housing via a coupling member, the second housing includes a guide track, and the coupling member is provided with a wheel in rolling contact with the guide track.

12. The infant bed apparatus according to claim 1, wherein the second portion is assembled with the second housing via a coupling member, and the motorized drive unit includes:

a motor having an output shaft;

a worm connected with the output shaft;

a worm gear meshed with the worm;

a first spur gear connected with the worm gear;

a second spur gear larger than and meshed with the first spur gear; and a linkage having two opposite ends respectively connected pivotally with the second spur gear and the coupling member.

13. The infant bed apparatus according to claim 1, wherein the second portion is assembled with the second housing via a coupling member, and the motorized drive unit includes:

a motor having an output shaft;

a crank having a first and a second end; and a first and a second bar linkage, the first bar linkage having a third and a fourth end, and the second bar linkage having a fifth and a sixth end;

wherein the first end is connected with the output shaft of the motor, the second and the third ends are pivotally connected with each other, the fourth and the fifth ends are pivotally connected with each other via a pivot shaft, and the sixth end is pivotally connected with the first housing.

14. The infant bed apparatus according to claim 13, wherein the coupling member is an elongated rod having a seventh and an eighth end, the seventh end being pivotally connected with the pivot shaft, and the eighth end being connected with the second portion of the bed frame.

15. The infant bed apparatus according to claim 1, wherein the support frame includes a curved foot portion adapted to rock on a ground surface, and at least one of the first and second housings includes a stabilizer foot operable to fold onto and deploy from the housing.

16. The infant bed apparatus according to claim 1, wherein each of the first and second housings respectively includes a latch operable to engage with an attachment structure that is configured to attach a bassinet to a play yard.

17. The infant bed apparatus according to claim 1, wherein each of the first and second housings respectively includes a latch operable to engage with an attachment structure that is configured to fasten onto a play yard.

18. The infant bed apparatus according to claim 16, wherein one of the first and second housings includes a first latch, and the other one of the first and second housings includes a second latch, the first latch projecting from a downwardly facing surface, and the second latch projecting from a substantially vertical surface.

19. The infant bed apparatus according to claim 18, wherein when the infant bed apparatus is installed on a play yard having an attachment structure, the downwardly facing surface is adapted to rest against a support surface of the attachment structure at an inner side of the play yard.

20. An infant bed apparatus comprising: a support frame including a first and a second housing disposed at two locations spaced-apart from each other along a lengthwise axis of the infant bed apparatus, the lengthwise axis corresponding to a direction of placement of a child in the bed frame, the support frame further including a curved foot portion adapted to rock on a ground surface, and at least one of the first and second housings including a stabilizer foot operable to fold onto and deploy from the housing; a bed frame defining an interior space suitable for receiving the placement of a child with the head and legs of the child disposed generally along the lengthwise axis, the bed frame having a first portion pivotally connected with the first housing and a second portion assembled with the second housing; and a motorized drive unit disposed in the second housing and operable to drive the second portion in movement relative to the second housing so as to cause a displacement of the second portion of the bed frame laterally relative to the lengthwise axis.

21. The infant bed apparatus according to claim 20, wherein the first housing is located proximate to a foot region of the bed frame, and the second housing is located proximate to a head region of the bed frame.

22. The infant bed apparatus according to claim 20, wherein the first housing includes a power source for supplying electric power to the motorized drive unit.

23. The infant bed apparatus according to claim 22, wherein the power source is electrically connected with the motorized drive unit via a wiring that is routed through a foot portion of the support frame.

24. The infant bed apparatus according to claim 20, wherein the second portion is assembled with the second housing via a coupling member, and the motorized drive unit is operable to cause a movement of the coupling member in a substantially horizontal plane.

25. The infant bed apparatus according to claim 20, wherein the second portion is assembled with the second housing via a coupling member, and the motorized drive unit is operable to cause a spatial motion of the coupling member that includes a horizontal component and a vertical component.

26. The infant bed apparatus according to claim 20, wherein the second portion is assembled with the second housing via a coupling member, the second housing includes a guide track, and the coupling member is provided with a wheel in rolling contact with the guide track.

27. The infant bed apparatus according to claim 20, wherein the second portion is assembled with the second housing via a coupling member, and the motorized drive unit includes:

a motor having an output shaft;

a worm connected with the output shaft;

a worm gear meshed with the worm;

a first spur gear connected with the worm gear;

a second spur gear larger than and meshed with the first spur gear; and a linkage having two opposite ends respectively connected pivotally with the second spur gear and the coupling member.

28. The infant bed apparatus according to claim 20, wherein the second portion is assembled with the second housing via a coupling member, and the motorized drive unit includes:

a motor having an output shaft;

a crank having a first and a second end; and a first and a second bar linkage, the first bar linkage having a third and a fourth end, and the second bar linkage having a fifth and a sixth end;

wherein the first end is connected with the output shaft of the motor, the second and the third ends are pivotally connected with each other, the fourth and the fifth ends are pivotally connected with each other via a pivot shaft, and the sixth end is pivotally connected with the first housing.

29. The infant bed apparatus according to claim 28, wherein the coupling member is an elongated rod having a seventh and an eighth end, the seventh end being pivotally connected with the pivot shaft, and the eighth end being connected with the second portion of the bed frame.

30. The infant bed apparatus according to claim 20, wherein each of the first and second housings respectively includes a latch operable to engage with an attachment structure that is configured to fasten a bassinet with a play yard.

31. The infant bed apparatus according to claim 30, wherein one of the first and second housings includes a first latch, and the other one of the first and second housings includes a second latch, the first latch projecting from a downwardly facing surface, and the second latch projecting from a substantially vertical surface.

32. The infant bed apparatus according to claim 31, wherein when the infant bed apparatus is installed on a play yard having an attachment structure, the downwardly facing surface is adapted to rest against a support surface of the attachment structure at an inner side of the play yard.

33. An infant bed apparatus comprising: a support frame including a first and a second housing disposed at two locations spaced-apart from each other along a lengthwise axis of the infant bed apparatus, and a curved foot portion adapted to rock on a ground surface, at least one of the first and second housings having a stabilizer foot operable to fold onto and deploy from the housing; a bed frame defining an interior space suitable for receiving the placement of a child along the lengthwise axis, the bed frame having a first portion pivotally connected with the first housing and a second portion assembled with the second housing; and a motorized drive unit disposed in the second housing and operable to drive the second portion in movement relative to the second housing so as to cause a displacement of the second portion of the bed frame laterally relative to the lengthwise axis.

* * * * *